US007845405B2

(12) United States Patent
Villareal et al.

(10) Patent No.: US 7,845,405 B2
(45) Date of Patent: Dec. 7, 2010

(54) FORMATION EVALUATION WHILE DRILLING

(75) Inventors: Steven G. Villareal, Houston, TX (US); Julian J. Pop, Houston, TX (US); Kent D. Harms, Richmond, TX (US); Victor M. Bolze, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/355,956

(22) Filed: Jan. 19, 2009

(65) Prior Publication Data

US 2009/0126996 A1 May 21, 2009

Related U.S. Application Data

(63) Continuation of application No. 11/942,796, filed on Nov. 20, 2007.

(51) Int. Cl.
*E21B 49/00* (2006.01)

(52) U.S. Cl. ..... 166/264; 166/100; 175/59

(58) Field of Classification Search ..... 175/59; 166/264, 100

See application file for complete search history.

(56) References Cited

U.S. PATENT DOCUMENTS 3,011,554 A 12/1961 Desbrandes et al.
3,289,474 A 12/1966 Smith
3,611,799 A 10/1971 Davis
3,859,851 A 1/1975 Urbanosky
3,894,780 A * 7/1975 Broussard ..... 175/325.6
4,416,152 A 11/1983 Wilson
4,507,957 A 4/1985 Montgomery et al.
4,856,585 A 8/1989 White et al.
4,860,581 A 8/1989 Zimmerman et al.
4,936,139 A 6/1990 Zimmerman et al.
5,233,866 A 8/1993 Desbrandes
5,303,775 A 4/1994 Michaels et al.
5,337,822 A * 8/1994 Massie et al. ..... 166/264
5,540,280 A 7/1996 Beck et al.
5,609,205 A 3/1997 Massie et al.
5,704,425 A * 1/1998 Divis et al. ..... 166/191
5,743,343 A * 4/1998 Heller et al. ..... 175/20
5,803,186 A 9/1998 Berger et al.
5,826,662 A 10/1998 Schultz et al.
6,216,782 B1 4/2001 Skinner
6,230,557 B1 5/2001 Ciglenec et al.
8,301,959 10/2001 Hrametz at al.
6,467,544 B1 10/2002 Brown et al.
6,585,045 B2 7/2003 Lee et al.
6,609,568 B2 8/2003 Krueger et al.
6,659,177 B2 12/2003 Bolze et al.
6,688,390 B2 2/2004 Bolze et al.
6,719,049 B2 4/2004 Sherwood et al.

(Continued)

*Primary Examiner*—Kenneth Thompson
*Assistant Examiner*—Sean D Andrish
(74) *Attorney, Agent, or Firm*—Dave R. Hofman

(57) ABSTRACT

A sample module for a sampling while drilling tool includes a sample fluid flowline operatively connectable between a sample chamber and an inlet, for passing a downhole fluid. A primary piston divides the sample chamber into a sample volume and a buffer volume and includes a first face in fluid communication with the sample volume and a second face in fluid communication with the buffer volume. An agitator is disposed in the sample volume for agitating the sample fluid. A secondary piston includes a first face in fluid communication with the buffer volume having buffer fluid disposed therein and a second face.

3 Claims, 18 Drawing Sheets

U.S. PATENT DOCUMENTS

| | | | |
|---|---|---|---|
| 6,837,314 | B2 | 1/2005 | Krueger et al. |
| 2003/0033866 | A1 | 2/2003 | Diakonov et al. |
| 2003/0066646 | A1 | 4/2003 | Shammai et al. |
| 2004/0000433 | A1 | 1/2004 | Hill et al. |
| 2004/0007058 | A1 | 1/2004 | Rylander et al. |
| 2004/0011525 | A1 | 1/2004 | Jones et al. |
| 2004/0026125 | A1 | 2/2004 | Meister et al. |
| 2004/0035199 | A1 | 2/2004 | Meister et al. |
| 2004/0083805 | A1 | 5/2004 | Ramakrishnan et al. |
| 2004/0089448 | A1 | 5/2004 | DiFoggio |
| 2004/0106524 | A1 | 6/2004 | Jones et al. |
| 2004/0160858 | A1 | 8/2004 | Ciglenec et al. |
| 2004/0163803 | A1 | 8/2004 | Ringgenberg et al. |
| 2004/0163808 | A1 | 8/2004 | Ringgenberg et al. |
| 2004/0216521 | A1 | 11/2004 | Shammai et al. |
| 2004/0216874 | A1 | 11/2004 | Grant et al. |
| 2004/0231841 | A1 | 11/2004 | Niemeyer et al. |
| 2004/0231842 | A1 | 11/2004 | Shammai et al. |
| 2004/0244971 | A1 | 12/2004 | Shammai et al. |
| 2004/0245016 | A1 | 12/2004 | Chemali et al. |
| 2004/0256161 | A1 | 12/2004 | Krueger et al. |
| 2005/0001624 | A1 | 1/2005 | Ritter et al. |
| 2005/0011644 | A1 | 1/2005 | Krueger et al. |
| 2005/0028974 | A1* | 2/2005 | Moody ..... 166/264 |
| 2005/0039527 | A1 | 2/2005 | Dhruva et al. |
| 2005/0072565 | A1 | 4/2005 | Segura et al. |
| 2005/0109538 | A1 | 5/2005 | Fisseler et al. |
| 2005/0115716 | A1 | 6/2005 | Ciglenec et al. |
| 2005/0150287 | A1 | 7/2005 | Carnegie et al. |
| 2005/0150688 | A1 | 7/2005 | MacGregor et al. |
| 2005/0205302 | A1 | 9/2005 | Meister et al. |
| 2005/0235745 | A1 | 10/2005 | Proett et al. |
| 2005/0246151 | A1 | 11/2005 | DiFoggio |
| 2007/0119587 | A1 | 5/2007 | Shammai et al. |
| 2008/0041593 | A1 | 2/2008 | Brown et al. |
| 2009/0126996 | A1 | 5/2009 | Villareal et al. |

* cited by examiner

FORMATION EVALUATION WHILE DRILLING

CROSS-REFERENCE TO RELATED APPLICATIONS

This application is a continuation of U.S. patent application Ser. No. 11/942,796, filed Nov. 20, 2007, and published as U.S. Patent Application Publication No. 2008/0087470 on Apr. 17, 2008, which is a continuation-in-part of U.S. Pat. No. 7,367,394.

FIELD OF THE DISCLOSURE

The present disclosure relates to techniques for evaluating a subsurface formation. More particularly, the present disclosure relates to techniques for collecting and/or storing fluid samples acquired from a subsurface formation.

BACKGROUND OF THE DISCLOSURE

Wellbores are drilled to locate and produce hydrocarbons. A downhole drilling tool with a bit at an end thereof is advanced into the ground to form a wellbore. As the drilling tool is advanced, a drilling mud is pumped from a surface mud pit, through the drilling tool and out the drill bit to cool the drilling tool and carry away cuttings. The fluid exits the drill bit and flows back up to the surface for recirculation through the tool. The drilling mud is also used to form a mudcake to line the wellbore.

During the drilling operation, it is desirable to perform various evaluations of the formations penetrated by the wellbore. In some cases, the drilling tool may be provided with devices to test and/or sample the surrounding formation. In some cases, the drilling tool may be removed and a wireline tool may be deployed into the wellbore to test and/or sample the formation. See, for example, U.S. Pat. Nos. 4,860,581 and 4,936,139. In other cases, the drilling tool may be used to perform the testing and/or sampling. See, for example, U.S. Pat. Nos. 5,233,866; 6,230,557; U.S. Patent Application Publication Nos. 2005/0109538 and 2004/0160858. These samples and/or tests may be used, for example, to locate valuable hydrocarbons.

Formation evaluation often requires that fluid from the formation be drawn into the downhole tool for testing and/or sampling. Various fluid communication devices, such as probes, are typically extended from the downhole tool and placed in contact with the wellbore wall to establish fluid communication with the formation surrounding the wellbore and to draw fluid into the downhole tool. A typical probe is a circular element extended from the downhole tool and positioned against the sidewall of the wellbore. A rubber packer at the end of the probe is used to create a seal with the wellbore sidewall.

Another device used to form a seal with the wellbore sidewall is referred to as a dual packer. With a dual packer, two elastomeric rings expand radially about the tool to isolate a portion of the wellbore therebetween. The rings form a seal with the wellbore wall and permit fluid to be drawn into the isolated portion of the wellbore and into an inlet in the downhole tool.

The mudcake lining the wellbore is often useful in assisting the probe and/or dual packers in making the seal with the wellbore wall. Once the seal is made, fluid from the formation is drawn into the downhole tool through an inlet by lowering the pressure in the downhole tool. Examples of probes and/or packers used in downhole tools are described in U.S. Pat. Nos. 6,301,959; 4,860,581; 4,936,139; 6,585,045; 6,609,568 and 6,719,049 and U.S. Patent Application Publication No. 2004/0000433.

In cases where a sample of fluid drawn into the tool is desired, a sample may be collected in one or more sample chambers or bottles positioned in the downhole tool. Examples of such sample chambers and sampling techniques used in wireline tools are described in U.S. Pat. Nos. 6,688,390, 6,659,177 and 5,303,775. Examples of such sample chambers and sampling techniques used in drilling tools are described in U.S. Pat. No. 5,233,866 and U.S. Patent Application Publication No. 2005/0115716. Typically, the sample chambers are removable from the downhole tool as shown, for example, in U.S. Pat. Nos. 6,837,314, 4,856,585 and 6,688,390.

Despite these advancements in sampling technology, there remains a need to provide sample chamber and/or sampling techniques capable of providing more efficient sampling in harsh drilling environments. It is desirable that such techniques are usable in the limited space of a downhole drilling tool and provide easy access to the sample. Such techniques preferably provide one or more of the following, among others: selective access to and/or removal of the sample chambers; locking mechanisms to secure the sample chamber; isolation from shocks, vibrations, cyclic deformations and/or other downhole stresses; protection of sample chamber sealing mechanisms; controlling thermal stresses related to sample chambers without inducing concentrated stresses or compromising utility; redundant sample chamber retainers and/or protectors; and modularity of the sample chambers. Such techniques are also preferably achieved without requiring the use of high cost materials to achieve the desired operability.

Additionally, there is a need for sample chambers that resist the high shock levels that are created during the drilling process. Such shocks may cause the pistons used in sample chambers to move. Unnecessary movement of the pistons causes the seals carried by the pistons to diminish, thereby leading to sample contamination. Conventional sample chambers also do not preserve the integrity of the sample in its travel from the point of collection downhole to surface, in particular, they do not adequately maintain the sample fluid in a single phase.

DEFINITIONS

Certain terms are defined throughout this description as they are first used, while certain other terms used in this description are defined below:

"Electrical" and "electrically" refer to connection(s) and/or line(s) for transmitting electronic signals;

"Electronic signals" mean signals that are capable of transmitting electrical power and/or data (e.g., binary data);

"Module" means a section of a downhole tool, particularly a multi-functional or integrated downhole tool having two or more interconnected modules, for performing a separate or discrete function;

"Modular" means adapted for (inter)connecting modules and/or tools, and possibly constructed with standardized units or dimensions for flexibility and variety in use;

"Single phase" refers to a fluid sample stored in a sample chamber, and means that the pressure of the chamber is maintained or controlled to such an extent that sample constituents which are maintained in a solution through pressure only, such as gasses and asphaltenes, should not separate out of solution as the sample cools upon retrieval of the chamber from a wellbore.

SUMMARY OF THE DISCLOSURE

According to one aspect of the disclosure, a sample module for a sampling while drilling tool includes a sample chamber operatively connectable via a sample fluid flowline to an inlet for passing a downhole fluid thereto, a primary piston slidably disposed within the sample chamber and a secondary piston. The primary piston divides the sample chamber into a sample volume and a buffer volume and includes a first face in fluid communication with the sample volume and a second face in fluid communication with the buffer volume. The secondary piston includes a first face in fluid communication with the buffer volume having buffer fluid disposed therein and a second face.

According to another aspect of the disclosure, a sample module for a sampling while drilling tool includes a detachable sample chamber operatively connectable via a sample fluid flowline to an inlet for passing a downhole fluid thereto at one end and a sealed end at another end. A primary piston is slidably disposed within the sample chamber and divides the sample chamber into a sample volume and a buffer volume. The primary piston includes a first face in fluid communication with the sample volume and a second face in fluid communication with the buffer volume.

According to another aspect of the disclosure, a method of obtaining a fluid sample with a sampling while drilling tool is disclosed. The method includes lowering a tool that includes a sample chamber having a first volume and a second volume in a wellbore; flowing a sample fluid through an inlet of the tool into the first volume of the sample chamber; moving a first piston disposed between the first and second volumes, thereby increasing the first volume; moving a buffer fluid from a first position to a second position with at least one of the first and a second piston; and moving the second piston disposed between the second and a third volume, thereby decreasing the third volume.

Other aspects of the disclosure may be discerned from the description.

BRIEF DESCRIPTION OF THE DRAWINGS

A more particular description of the disclosure, briefly summarized above, is provided by reference to embodiments thereof that are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

So that the above recited features and advantages of the present disclosure can be understood in detail, a more particular description of the disclosure, briefly summarized above, may be had by reference to the embodiments thereof that are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1:
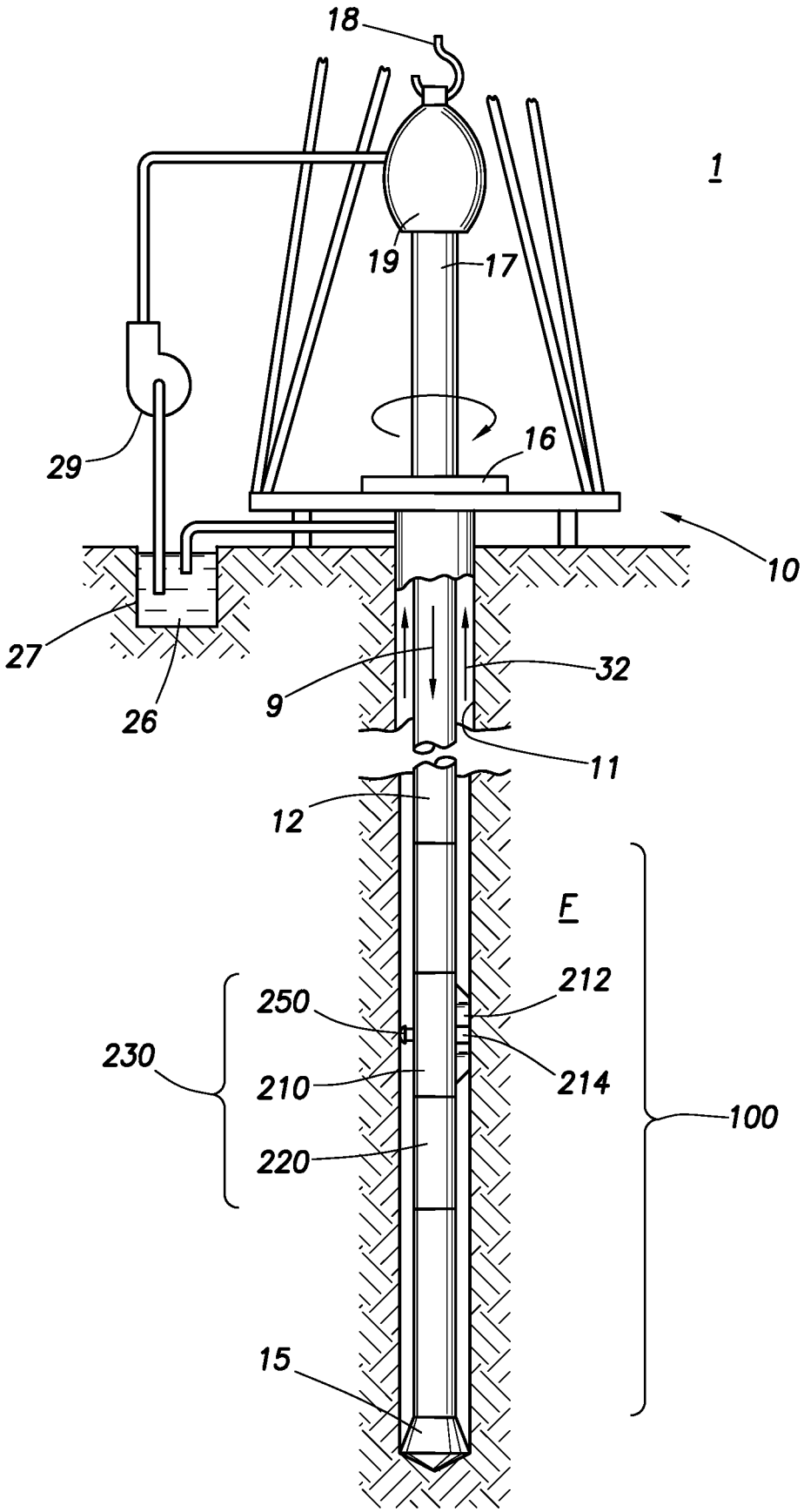
FIG. 1 is a schematic representation of a wellsite having a downhole tool positioned in a wellbore penetrating a subterranean formation, the downhole tool having a sampling while drilling ("SWD") system.

FIG. 1 depicts a wellsite I including a rig 10 with a downhole tool 100 suspended therefrom and into a wellbore 11 via a drill string 12. The downhole tool 10 has a drill bit 15 at its lower end thereof that is used to advance the downhole tool into the formation and form the wellbore.

The drillstring 12 is rotated by a rotary table 16, energized by means not shown, which engages a kelly 17 at the upper end of the drillstring. The drillstring 12 is suspended from a hook 18, attached to a traveling block (also not shown), through the kelly 17 and a rotary swivel 19 which permits rotation of the drillstring relative to the hook.

The rig is depicted as a land-based platform and derrick assembly 10 used to form the wellbore 11 by rotary drilling in a manner that is well known. Those of ordinary skill in the art given the benefit of this disclosure will appreciate, however, that the present disclosure also finds application in other downhole applications, such as rotary drilling, and is not limited to land-based rigs.

Drilling fluid or mud 26 is stored in a pit 27 formed at the well site. A pump 29 delivers drilling fluid 26 to the interior of the drillstring 12 via a port in the swivel 19, inducing the drilling fluid to flow downwardly through the drillstring 12 as indicated by a directional arrow 9. The drilling fluid exits the drillstring 12 via ports in the drill bit 15, and then circulates upwardly through the region between the outside of the drillstring and the wall of the wellbore, called the annulus, as indicated by direction arrows 32. In this manner, the drilling fluid lubricates the drill bit 15 and carries formation cuttings up to the surface as it is returned to the pit 27 for recirculation.

The downhole tool 100, sometimes referred to as a bottom hole assembly ("BHA"), is preferably positioned near the drill bit 15 (in other words, within several drill collar lengths from the drill bit). The bottom hole assembly includes various components with capabilities, such as measuring, processing, and storing information, as well as communicating with the surface. A telemetry device (not shown) is also preferably provided for communicating with a surface unit (not shown).

The BHA 100 further includes a sampling while drilling ("SWD") system 230 including a fluid communication module 210 and a sample module 220. The modules are preferably housed in a drill collar for performing various formation evaluation functions (described in detail below). As shown in FIG. 1, the fluid communication module 210 is preferably positioned adjacent the sample module 220. The fluid communication module is depicted as having a probe with an inlet for receiving formation fluid. Additional devices, such as pumps, gauges, sensor, monitors or other devices usable in downhole sampling and/or testing may also be provided. While FIG. 1 is depicted as having a modular construction with specific components in certain modules, the tool may be unitary or select portions thereof may be modular. The modules and/or the components therein may be positioned in a variety of configurations throughout the downhole tool.

The fluid communication module 210 has a fluid communication device 214, such as a probe, preferably positioned in a stabilizer blade or rib 212. An exemplary fluid communication device that can be used is depicted in US patent Application No. 20050109538, the entire contents of which are hereby incorporated by reference. The fluid communication device is provided with an inlet for receiving downhole fluids and a flowline (not shown) extending into the downhole tool for passing fluids therethrough. The fluid communication device is preferably movable between extended and retracted positions for selectively engaging a wall of the wellbore 11 and acquiring a plurality of fluid samples from the formation F. As shown, a back up piston 250 may be provided to assist in positioning the fluid communication device against the wellbore wall.

Examples of fluid communication devices, such as probes or packers, that can be used, are described in greater detail in Application Nos. US 2005/0109538 and U.S. Pat. No. 5,803,186. A variety of fluid communication devices alone or in combination with protuberant devices, such as stabilizer blades or ribs, may be used.

Figure 2A:
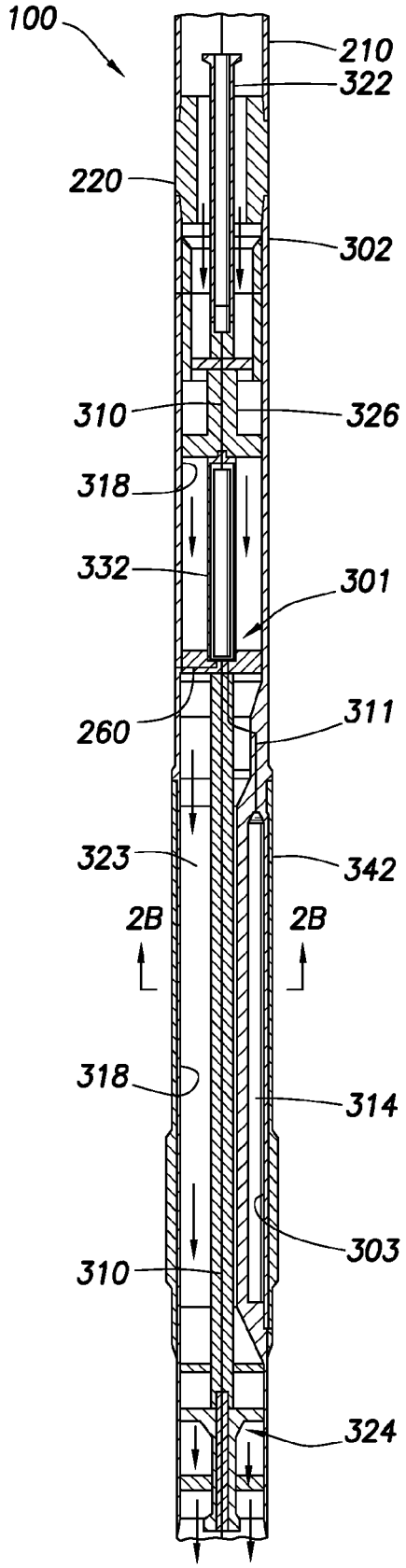
FIG. 2A is a longitudinal cross-sectional representation of a portion of the downhole tool of FIG. 1 depicting a sample module of the SWD system in greater detail, the sample module having a fluid flow system and a plurality of sample chambers therein.
Figure 2B:
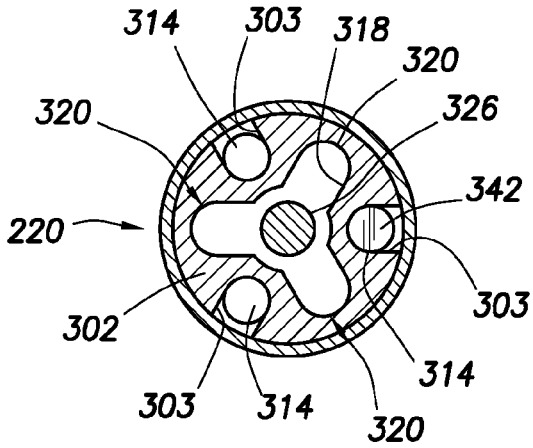
FIG. 2B is a horizontal cross-sectional representation of the sample module of FIG. 2A, taken along section line 2B-2B.

FIGS. 2A and 2B depict a portion of the downhole tool 100 with the sample module 220 of FIG. 1 shown in greater detail. FIG. 2A is a longitudinal cross-section of a portion of the probe module 210 and the sample module 220. FIG. 2B is a horizontal cross-sectional of the sample module 220 taken along section line 2B-2B of FIG. 2A.

The sample module 220 is preferably housed in a drill collar 302 that is threadably connectable to adjacent drill collars of the BHA, such as the probe module 210 of FIG. 1. The drill collar has a mandrel 326 supported therein. A passage extends between the mandrel and the drill collar to permit the passage of mud therethrough as indicated by the arrows.

The sample chamber, drill collar and associated components may be made of high strength materials, such as stainless steel alloy, titanium or inconel. However, the materials may be selected to achieve the desired thermal expansion matching between components. In particular, it may be desirable to use a combination of low cost, high strength and limited thermal expansion materials, such as PEEK (polyetheretherketone) or kevlar.

Interface 322 is provided at an end thereof to provide hydraulic and/or electrical connections with an adjacent drill collar. An additional interface 324 may be provided at another end to operatively connect to adjacent drill collars if desired. In this manner, fluid and/or signals may be passed between the sample module and other modules as described, for example, in U.S. patent application Ser. No. 11/160,240. In this case, such an interface is preferably provided to establish fluid communication between the fluid communication module and the sample module to pass formation fluid received by the fluid communication module to the sample module.

Interface 322 is depicted as being at an uphole end of the sample module 220 for operative connection with adjacent fluid communication module 210. However, it will be appreciated that one or more fluid communication and/or probe modules may be positioned in the downhole tool with one or more interfaces at either or both ends thereof for operative connection with adjacent modules. In some cases one or more intervening modules may be positioned between the fluid communication and probe modules.

The sample module has fluid flow system 301 for passing fluid through the drill collar 302. The fluid flow system includes a primary flow line 310 that extends from the interface and into the downhole tool. The flowline is preferably in fluid communication with the flowline of the fluid communication module via the interface for receiving fluids received thereby. As shown, the flowline is positioned in mandrel 326 and conducts fluid, received from the fluid communication module through the sample module.

As shown, the fluid flow system 301 also has a secondary flowline 311 and a dump flowline 260. The secondary flowline diverts fluid from the primary flowline 310 to one or more sample chambers 314 for collection therein. Additional flowlines, such as dump flowline 260 may also be provided to divert flow to the wellbore or other locations in the downhole tool. As shown, a flow diverter 332 is provided to selectively divert fluid to various locations. One or more such diverters may be provided to divert fluid to desired locations.

The sample chambers may be provided with various devices, such as valves, pistons, pressure chambers or other devices to assist in manipulating the capture of fluid and/or maintaining the quality of such fluid. The sample chambers 314 are each adapted for receiving a sample of formation fluid, acquired through the probe 214 (see FIG. 1), via the primary flow line 310 and respective secondary flow lines 311.

As shown, the sample chambers are preferably removably positioned in an aperture 303 in drill collar 302. A cover 342 is positioned about the sample chambers and drill collar 302 to retain the sample chambers therein.

As seen in the horizontal cross-section taken along line 2B-2B of FIG. 2A and shown in FIG. 2B, the sample module is provided with three sample chambers 314. The sample chambers 314 are preferably evenly spaced apart within the body at 120 degree intervals. However, it will be appreciated that one or more sample chambers in a variety of configurations may be positioned about the drill collar. Additional sample chambers may also be positioned in additional vertical locations about the module and/or downhole tool.

The chambers are preferably positioned about the periphery of the drill collar 302. As shown the chambers are removably positioned in apertures 303 in the drill collar 302. The apertures are configured to receive the sample chambers. Preferably, the sample chambers fit in the apertures in a manner that prevents damage when exposed to the harsh wellbore conditions.

Passage 318 extends through the downhole tool. The passage preferably defines a plurality of radially-projecting lobes 320. The number of lobes 320 is preferably equal to the number of sample chambers 314, i.e., three in FIG. 2B. As shown, the lobes 320 project between the sample chambers 314 at a spacing interval of about 60 degrees therefrom. Preferably, the lobes expand the dimension of the passage about the sample chambers to permit drilling fluid to pass therethrough.

The lobed bore 318 is preferably configured to provide adequate flow area for the drilling fluid to be conducted through the drillstring past the sample chambers 314. It is further preferred that the chambers and/or containers be positioned in a balanced configuration that reduces drilling rotation induced wobbling tendencies, reduces erosion of the downhole tool and simplifies manufacturing. It is desirable that such a configuration be provided to optimize the mechanical strength of the sample module, while facilitating fluid flow therethrough. The configuration is desirably adjusted to enhance the operability of the downhole tool and the sampling while drilling system.

Figure 3:
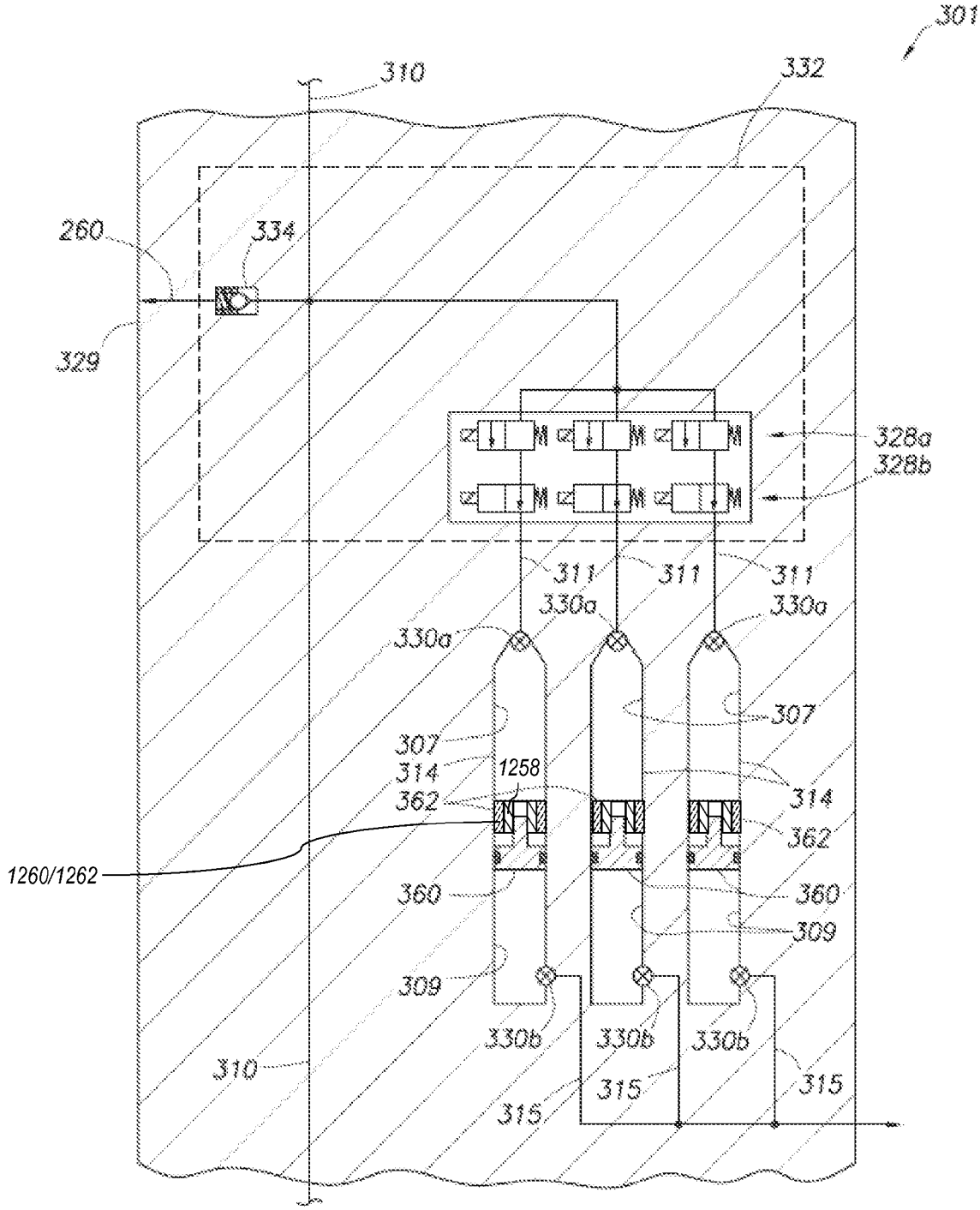
FIG. 3 is a schematic representation of the fluid flow system of FIGS. 2A and 2B.

FIG. 3 is a schematic representation of the fluid flow system 301 of the sample module 220 of FIGS. 2A-2B. As described above, the fluid flow system 301 includes a flow diverter 332 for selectively diverting flow through the sample module and a plurality of sample chambers 314. The flow diverter selectively diverts fluid from primary flowline 310 to secondary flowlines 311 leading to sample chambers 314 and/or a dump flowline 260 leading to the wellbore.

One or more flowlines valves may be provided to selectively divert fluid to desired locations throughout the downhole tool. In some cases, fluid is diverted to the sample chamber(s) for collection. In other cases, fluid may be diverted to the wellbore, the passage 318 or other locations as desired.

The secondary flowlines 311 branch off from primary flowline 310 and extend to sample chambers 314. The sample chambers may be any type of sample chamber known in the art to capture downhole fluid samples. As shown, the sample chambers preferably include a slidable piston 360 defining a variable volume sample cavity 307 and a variable volume buffer cavity 309. The sample cavity is adapted to receive and house the fluid sample. The buffer cavity typically contains a buffer fluid that applies a pressure to the piston to maintain a pressure differential between the cavities sufficient to maintain the pressure of the sample as it flows into the sample cavity. Additional features, such as pressure compensators, pressure chambers, sensors and other components may be used with the sample chambers as desired.

The sample chamber is also preferably provided with an agitator 362 positioned in the sample chamber. The agitator may be a rotating blade or other mixing device capable of moving the fluid in the sample chamber to retain the quality thereof.

Each sample chamber 314 is shown to have container valves 330*a*, 330*b*. Container valves 330*a* are preferably provided to selectively fluidly connect the sample cavity of the sample chambers to flowline 311. The chamber valves 330*b* selectively fluidly connect the buffer cavity of the sample chambers to a pressure source, such as the wellbore, a nitrogen charging chamber or other pressure source.

Each sample chamber 314 is also associated with a set of flowline valves 328*a*, 328*b* inside a flow diverter/router 332, for controlling the flow of fluid into the sample chamber. One or more of the flowline valves may be selectively activated to permit fluid from flowline 310 to enter the sample cavity of one or more of the sample chambers. A check valve may be employed in one or more flow lines to restrict flow therethrough.

Additional valves may be provided in various locations about the flowline to permit selective fluid communication between locations. For example, a valve 334, such as a relief or check valve, is preferably provided in a dump flowline 260 to allow selective fluid communication with the wellbore. This permits formation fluid to selectively eject fluid from the flowline 260. This fluid is typically dumped out dump flowline 260 and out the tool body's sidewall 329. Valve 334 may also be is preferably open to the wellbore at a given differential pressure setting. Valve 334 may be a relief or seal valve that is controlled passively, actively or by a preset relief pressure. The relief valve 334 may be used to flush the flowline 310 before sampling and/or to prevent over-pressuring of fluid samples pumped into the respective sample chambers 314. The relief valve may also be used as a safety to prevent trapping high pressure at the surface.

Additional flowlines and valves may also be provided as desired to manipulate the flow of fluid through the tool. For example, a wellbore flowline 315 is preferably provided to establish fluid communication between buffer cavities 309 and the wellbore. Valves 330*b* permit selective fluid communication with the buffer chambers.

In instances where multiple sample modules 220 are run in a tool string, the respective relief valves 334 may be operated in a selective fashion, e.g., so as to be active when the sample chambers of each respective module 220 are being filled. Thus, while fluid samples are routed to a first sample module 220, its corresponding relief valve 334 may be operable. Once all the sample chambers 314 of the first sample module 220 are filled, its relief valve is disabled. The relief valve of an additional sample module may then be enabled to permit flushing of the flow line in the additional sample module prior to sample acquisition (and/or over-pressure protection). The position and activation of such valves may be actuated manually or automatically to achieve the desired operation.

Valves 328*a*, 328*b* are preferably provided in flowlines 311 to permit selective fluid communication between the primary flowline 310 and the sample cavity 307. These valves may be selectively actuated to open and close the secondary flow lines 311 sequentially or independently.

The valves 328*a, b* are preferably electric valves adapted to selectively permit fluid communication. These valves are also preferably selectively actuated. Such valves may be provided with a spring-loaded stem (not shown) that biases the valves to either an open or closed position. In some cases, the valves may be commercially available exo or seal valves.

To operate the valves, an electric current is applied across the exo washers, causing the washers to fail, which in turn releases the springs to push their respective stems to its other, normal position. Fluid sample storage may therefore be achieved by actuating the (first) valves 328*a* from the displaced closed positions to the normal open positions, which allows fluid samples to enter and fill the sample chambers 314. The collected samples may be sealed by actuating the (second) valves 328*b* from the displaced open positions to the normal closed positions.

The valves are preferably selectively operated to facilitate the flow of fluid through the flowlines. The valves may also be used to seal fluid in the sample chambers. Once the sample chambers are sealed, they may be removed for testing, evaluation and/or transport. The valves 330*a* (valve 330*b* may remain open to expose the backside of the container piston 360 to wellbore fluid pressure) are preferably actuated after the sample module 220 is retrieved from the wellbore to provide physical access by an operator at the surface. Accordingly, a protective cover (described below) may be equipped with a window for quickly accessing the manually-operable valves—even when the cover is moved to a position closing the sample chamber apertures 313 (FIG. 4).

One or more of the valves may be remotely controlled from the surface, for example, by using standard mud-pulse telemetry, or other suitable telemetry means (e.g., wired drill pipe). The sample module 220 may be equipped with its own modem and electronics (not shown) for deciphering and executing the telemetry signals. Alternatively, one or more of the valves may be manually activated. Downhole processors may also be provided for such actuation.

Those skilled in the art will appreciate that a variety of valves can be employed. Those skilled in the art will appreciate that alternative sample chamber designs can be used. Those skilled in the art will appreciate that alternative fluid flow system designs can be used.

Figure 4A:
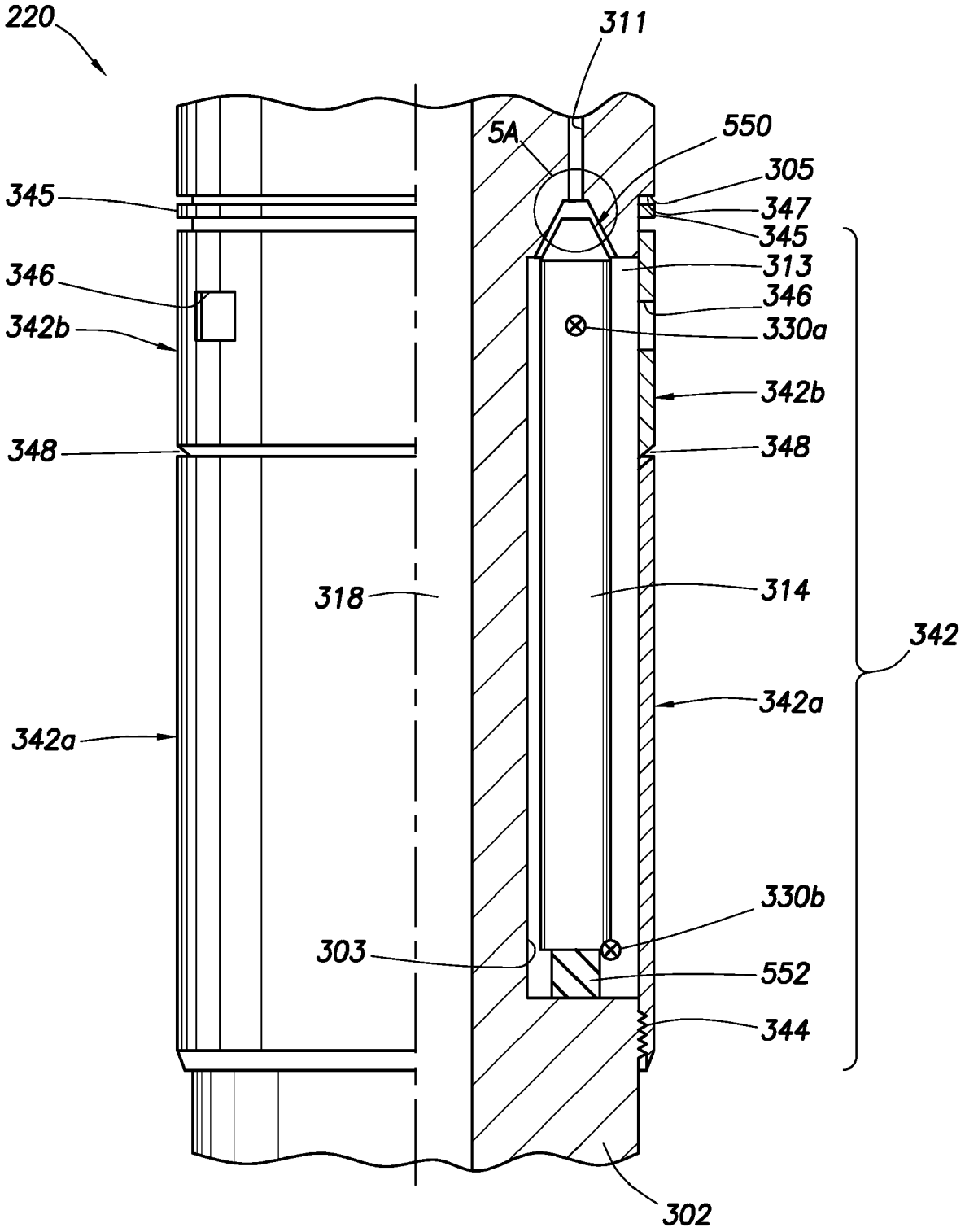
FIG. 4A is a partial sectional representation of the sample module of FIG. 2A having a removable sample chamber retained therein by a two piece cover.
Figure 4B:
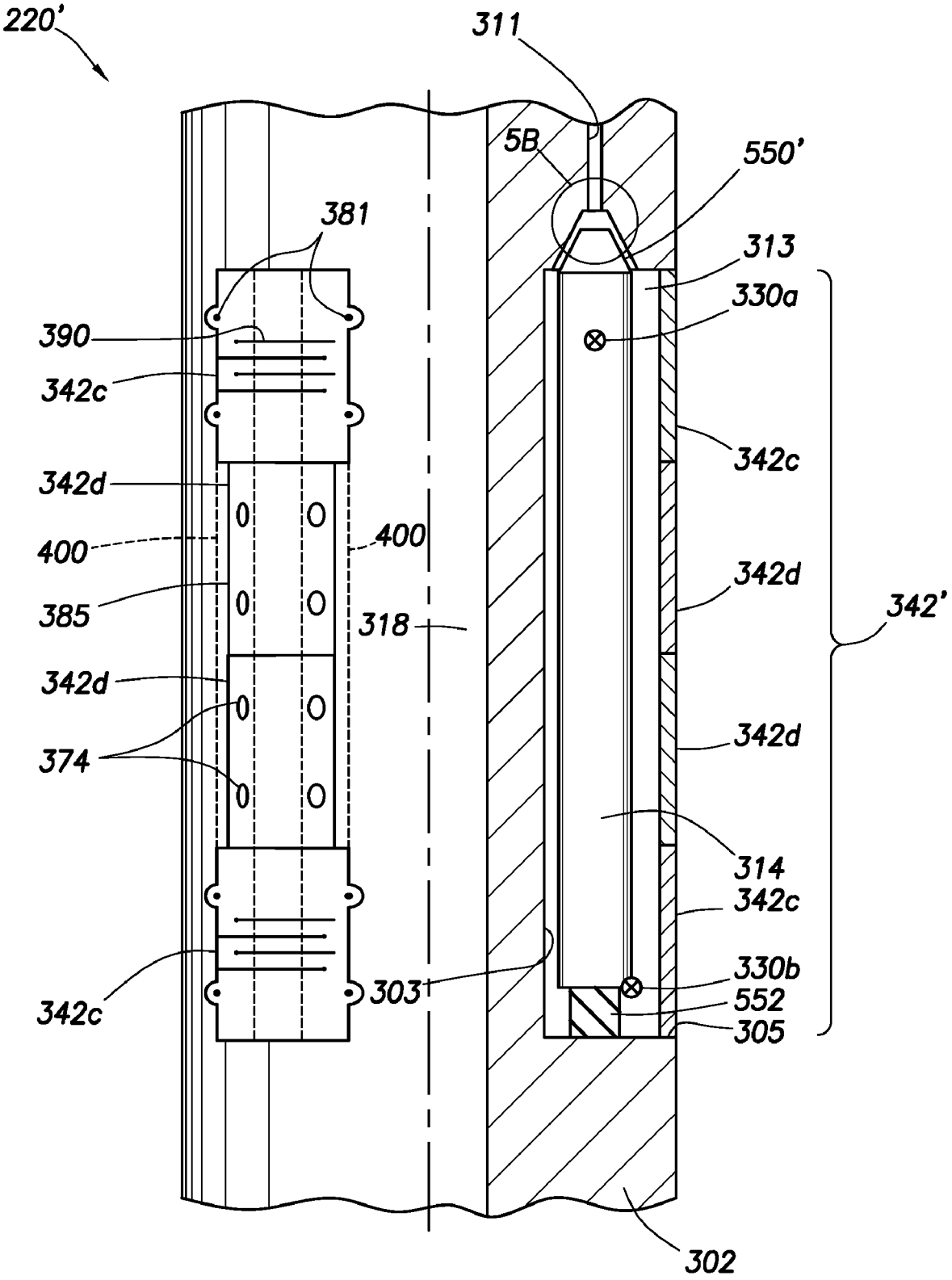
FIG. 4B is a partial sectional representation of an alternate sample module having a removable sample chamber retained therein by a multi-piece cover.

FIGS. 4A and 4B depict techniques for removably positioning sample chambers in the downhole tool. FIG. 4A depicts a sample chamber retained with the downhole tool by a cover, such as a ring or sleeve, slidably positionable about the outer surface of the drill collar to cover one or more openings therein. FIG. 4B depicts a cover, such as a plate or lid, positionable over an opening in the drill collar.

FIG. 4A is a partial sectional representation of the sample module 220, showing a sample chamber 314 retained therein. The sample chamber is positioned in aperture 303 in drill collar 302. The drill collar has a passage 318 for the passage of mud therethrough.

Cover 342 is positioned about the drill collar to retain the sample chamber in the downhole tool. The sample chambers 314 are positioned in the apertures 303 in drill collar 302. Cover 342 is preferably a ring slidably positionable about drill collar 302 to provide access to the sample chambers 314. Such access permits insertion and withdrawal of sample chamber 314 from the drill collar 302.

The cover 342 acts as a gate in the form of a protective cylindrical cover that preferably fits closely about a portion of the drill collar 302. The cover 342 is movable between positions closing (see FIG. 4A) and opening (not shown) the one or more apertures 303 in the drill collar. The cover thereby provides selective access to the sample chambers 314. The cover also preferably prevents the entry of large particles, such as cuttings, from the wellbore into the aperture when in the closed position.

The cover 342 may comprise one or more components that are slidable along drill collar 302. The cover preferably has an outer surface adapted to provide mechanical protection from the drilling environment. The cover is also preferably fitted about the sample chamber to seal the opening(s) and/or secure the sample chamber in position and prevent damage due to harsh conditions, such as shock, external abrasive forces and vibration.

The cover 342 is operatively connected to the drill collar 302 to provide selective access to the sample chambers. As shown, the cover has a first cover section 342*a* and a second cover section 342*b*. The first cover section 342*a* is held in place about drill collar 302 by connection means, such as engaging threads 344, for operatively connecting an inner surface of the first cover section 342*a* and an outer surface of the drill collar 302.

The cover may be formed as a single piece, or it may include two or more complementing sections. For example, FIG. 4A illustrates a two-piece cover 342 with first and second cover sections 342*a*, 342*b*. Both the first cover section 342*a* and second cover section 342*b* are preferably slidably positioned about an opening 305 the tool body 302. The first cover section 342*b* may be slid about the drill collar until it rests upon a downwardly-facing shoulder 347 of the body. A shim 345, or a bellows, spring-washer stack or other device capable of axial loading of the sample chamber to secure it in place, may be positioned between the shoulder 347 and the first cover section 342*b*. The second cover section 342*a* may also be slidably positioned about the drill collar 302. The cover sections have complementing stops (referenced as 348) adapted for operative connection therebetween. The second cover section may be operatively connected to the first cover section before or after positioning the covers sections about the drill collar. The first cover section is also threaded onto the drill collar at threaded connection 344.

The cover sections may then be rotated relative to the drill collar 302 to tighten the threaded connection 344 and secure the cover sections in place. Preferably, the covers are securably positioned to preload the cover sections and reduce (or eliminate) relative motion between the cover sections and the tool body 302 during drilling.

The cover 342 may be removed from drill collar 302 to access the sample chambers. For example, the cover 342 may be rotated to un-mate the threaded connection 344 to allow access to the sample chamber. The cover 342 may be provided with one or more windows 346. Window 346 of the cover 342 may be used to access the sample chamber 314. The window may be used to access valves 330*a*, 330*b* on the sample chamber 314. Window 346 permits the manual valve 330*a* to be accessed at the surface without the need for removing the cover 342. Also, it will be appreciated by those skilled in that art that a windowed cover may be bolted or otherwise operatively connected to the tool body 302 instead of being threadably engaged thereto. One or more such windows and/or covers may be provided about the drill collar to selectively provide access and/or to secure the sample chamber in the drill collar.

The sample chamber is preferably removably supported in the drill collar. The sample chamber is supported at an end thereof by a shock absorber 552. An interface 550 is provided at an opposite end adjacent flowline 311 to operatively connect the sample chamber thereto. The interface 550 is also preferably adapted to releasably secure the sample chamber in the drill collar. The interface and shock absorbers may be used to assist in securing the sample chamber in the tool body. These devices may be used to provide redundant retainer mechanisms for the sample chambers in addition to the cover 342.

FIG. 4B depicts an alternate sample module 220'. The sample module 220' is the same as the sample module 220 of FIG. 4A, except that the sample chamber 314' is retained in drill collar 302 by cover 342', an interface 550' and a shock absorber 552. The cover 342' includes a plurality of cover portions 342*c* and 342*d*.

Cover 342*d* is slidably positionable in opening 305 of the drill collar 302. Cover 342' is preferably a rectangular plate having an overhang 385 along an edge thereof. The cover may be inserted into the drill collar such that the overhang 385 engages an inner surface 400 of the drill collar. The overhang allows the cover to slidingly engage the inner surface of the drill collar and be retained therein. One or more covers 342*d* are typically configured such that they may be dropped into the opening 305 and slid over the sample chamber 314 to the desired position along the chamber cavity opening. The covers may be provided with countersink holes 374 to aid in the removal of the cover 342*d*. The cover 342*d* may be configured with one or more windows, such as the window 346 of FIG. 4A.

Cover 342*c* is preferably a rectangular plate connectable to drill collar 302 about opening 305. The cover is preferably removably connected to the drill collar by bolts, screws or other fasteners. The cover may be slidably positionable along the drill collar and secured into place. The cover may be provided with receptacles 381 extending from its sides and having holes therethrough for attaching fasteners therethrough.

The covers as provided herein are preferably configured with the appropriate width to fit snuggly within the opening 305 of the drill collar. One or more such covers or similar or different configurations may be used. The covers may be provided with devices to prevent damage thereto, such as the strain relief cuts 390 in cover 342 of FIG. 4B. In this manner, the covers may act as shields.

Figure 5B:
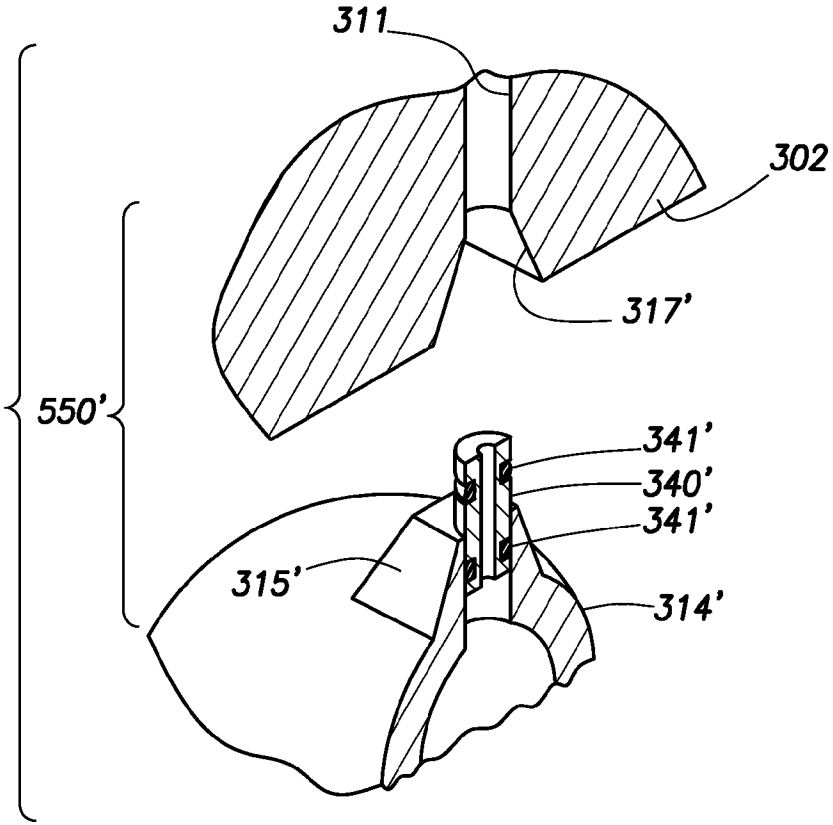
FIG. 5B is an isometric representation, partially in section, of an alternate sample module and interface.
Figure 5A:
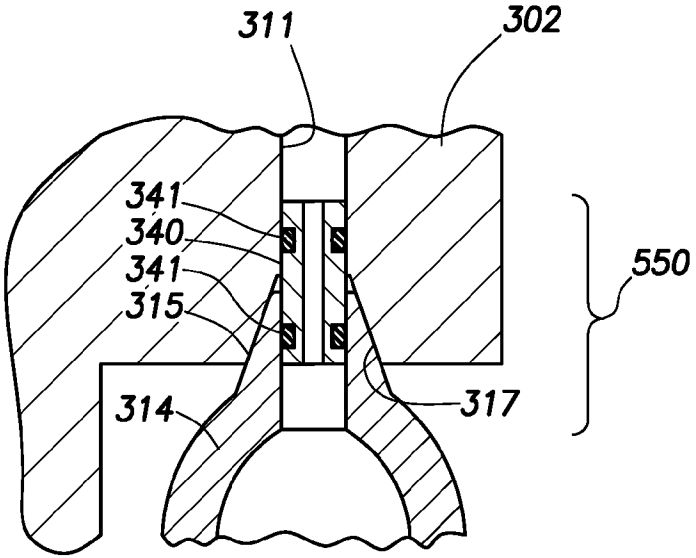
FIG. 5A is a detailed sectional representation of a portion of the sample module of FIG. 4A depicting an interface thereof in greater detail.

FIG. 5A is a detailed representation of a portion of the sample module of FIG. 4A depicting the interface 550 in greater detail. The interface includes a hydraulic stabber 340 fluidly connecting the sample chamber 314 disposed therein to one of the secondary flow lines 311. The sample chamber 314 has a conical neck 315 having an inlet for passing fluids therethrough. The lower portion of the hydraulic stabber 340 is in fluid-sealing engagement with the conical neck 315 of the sample chamber 314, and the upper portion of the hydraulic stabber in fluid-sealing engagement with the secondary flow line 311 of the drill collar 302.

Such retainer mechanisms are preferably positioned at each of the ends of the sample chambers to releasably retain the sample chamber. A first end of the sample chamber 314 may be laterally fixed, e.g., by sample chamber neck 315. An opposite end typically may also be provided with a retainer mechanism. Alternatively, the opposite end may be held in place by shock absorber 552 (FIG. 4A). These retainer mechanisms may be reversed or various combinations of retainer mechanisms may be used.

The conical neck 315 of the sample chamber 314 is supported in a complementing conical aperture 317 in the tool body 302. This engagement of conical surfaces constitutes a portion of a retainer for the sample chamber. The conical neck may be used to provide lateral support for the sample chamber 314. The conical neck may be used in combination with other mechanisms, such as an axial loading device (described below), to support the sample chamber in place. Preferably, little if any forces are acting on the hydraulic stabber 340 and its O-ring seals 341 to prevent wear of the stabber/seal materials and erosion thereof over time. The absence of forces at the hydraulic seals 341 preferably equates to minimal, if any, relative motion at the seals 341, thereby reducing the likelihood of leakage past the seals.

FIG. 5B is a detailed view of a portion of the sample module 220' of FIG. 4B with an alternate interface to that of FIG. 4A. The sample chamber 314' of FIG. 5B is equipped with double-wedge or pyramidal neck 315' that engages a complementing pyramidal aperture 317' in the tool body 302. Hydraulic stabber 340' is positioned in an inlet in pyramidal neck 315' for insertion into pyramidal aperture 317' for fluidly coupling the sample chamber to flowline 311. Hydraulic seals 341' are preferably provided to fluidly seal the sample chamber to the drill collar.

This pyramidal engagement provides torsional support for the sample chamber, and prevents it from rotating about its axis within the sample chamber. This functionality may be desirable to ensure a proper alignment of manually operated valves 330*a'* and 330*b'* within the opening 313 of the sample chambers 314.

FIGS. 6A-D illustrate a portion of the sample module 220 of FIG. 4A in greater detail. In these figures, the sample module 220 is provided with alternative configurations of retainers 552*a-d* usable as the shock absorbers 552 and/or 552' of FIGS. 4A-4B. These retainers assist in supporting sample chamber 314 within aperture 303 of drill collar 302. Cover 342 also assists in retaining sample chamber 314 in position. The retainer and/or cover also preferably provide shock absorption and otherwise assist in preventing damage to the sample chamber.

Figure 6B:
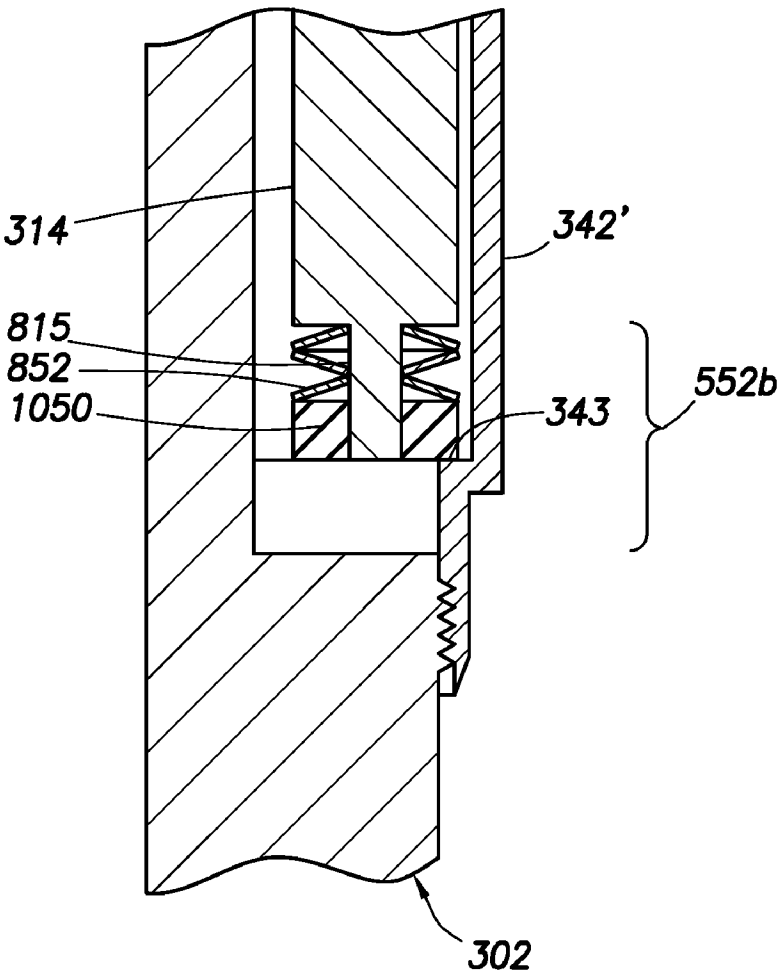
FIGS. 6A-6D are detailed sectional representations of a portion of the sample module of FIG. 4A depicting the shock absorber in greater detail.
Figure 6A:
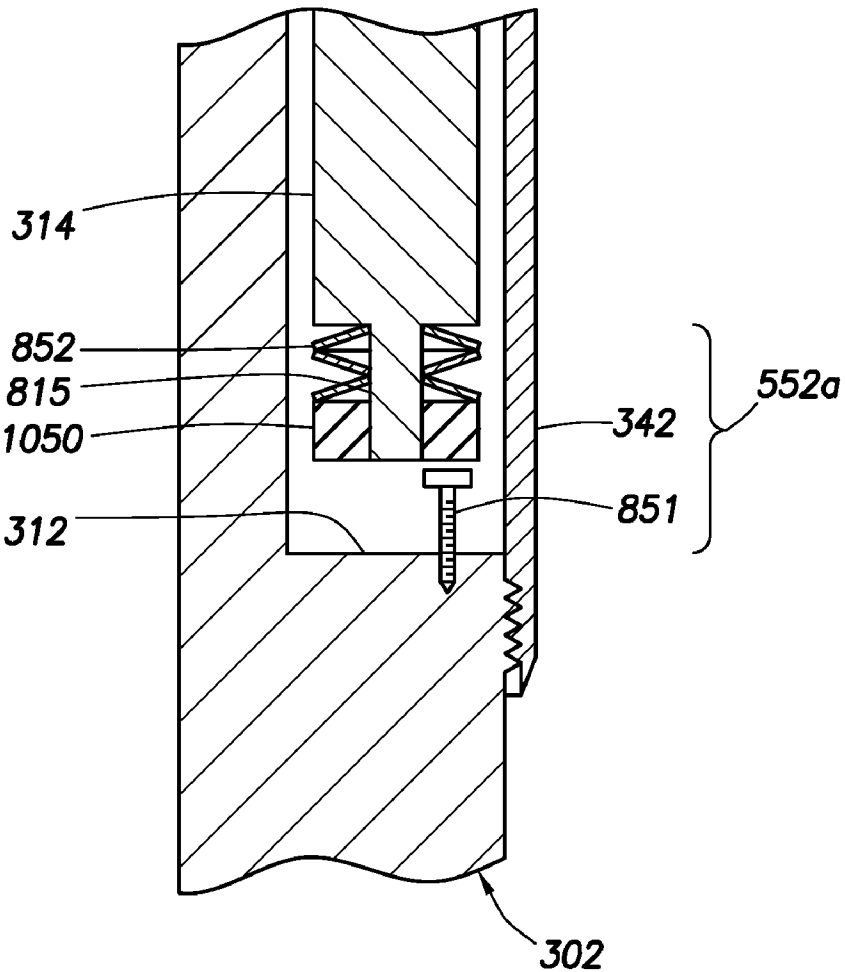

As shown in FIG. 6A, the retainer 552*a* includes an axial-loading device 1050 and a washer 852. An adjustable setscrew 851 is also provided between the drill collar 302 and the retainer 552*a* to adjustably position the sample chamber 314 within the drill collar. The washer may be a belleville stack washer or other spring mechanism to counteract drilling shock, internal pressure in the sample chamber and/or assist in shock absorption.

The sample chamber preferably has a tip 815 extending from an end thereof. The tip 815 is preferably provided to support washer 852 and axial loading device 1050 at an end of the sample chamber.

FIG. 6B shows an alternate shock absorber 552*b*. The retainer 552*b* is essentially the same as the retainer 552*a*, but does not have a setscrew 851. In this configuration, support is provided by cover 342'. Cover 342' operates the same as covers 342, but is provided with a stepped inner surface 343. The stepped inner surface defines a cover shoulder 343 adapted to support sample chamber 314 within drill collar 302.

Figure 6D:
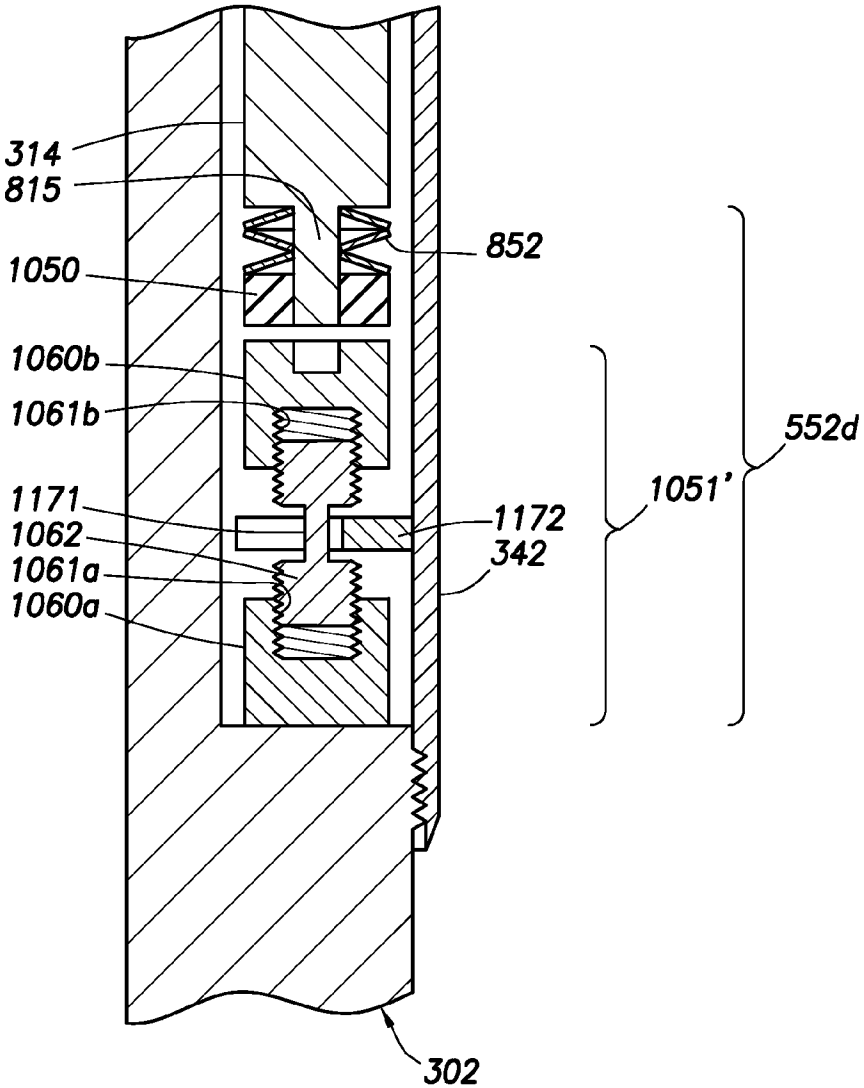
Figure 6C:
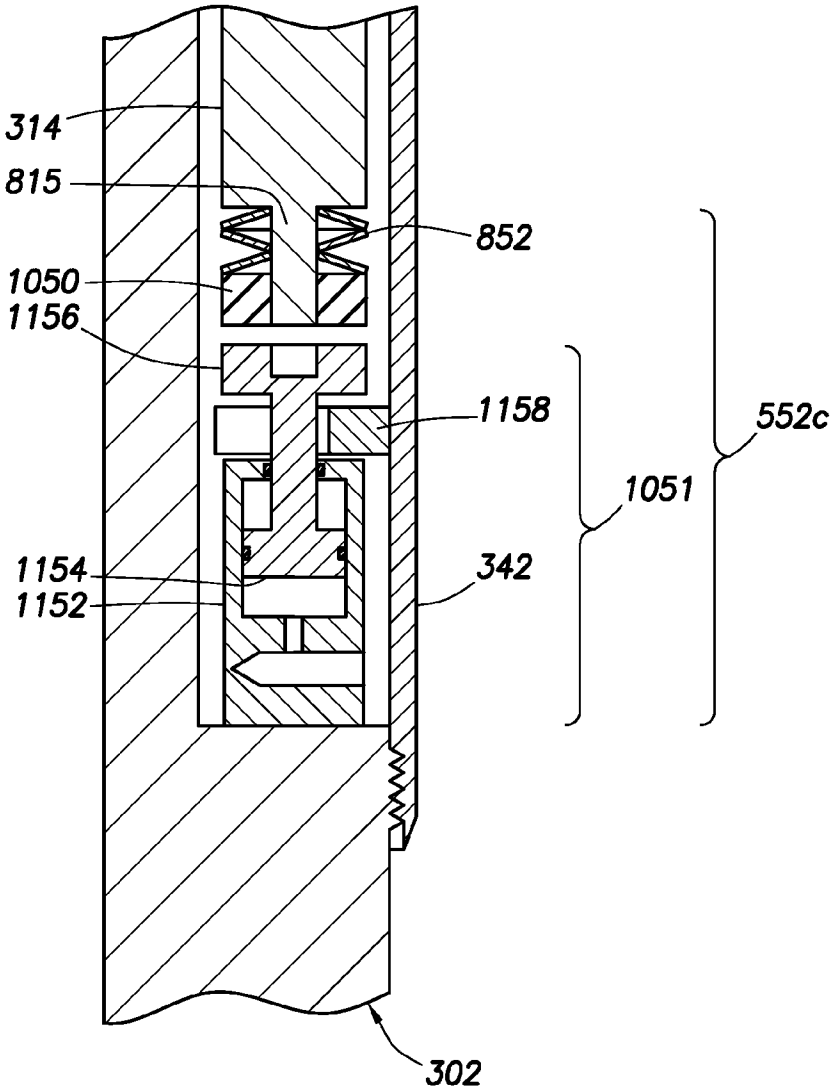

Referring now to FIG. 6C, the shock absorber 552*c* is the same as the shock absorber 552*a* of FIG. 6A, but is further provided with a hydraulic jack 1051. The hydraulic jack includes a hydraulic cylinder 1152, a hydraulic piston 1154, and a hydraulic ram 1156 that are operable to axially load the axial loading spacer 1050.

When the cover 342 is open (not shown), the hydraulic jack may be extended under pressurized hydraulic fluid (e.g., using a surface source) to fully compress the washer (spring member) 852. An axial lock (not shown) is then inserted and the pressure in the hydraulic cylinder 1152 may be released. The length of the axial lock is preferably dimensioned so that the counteracting spring force of the spring member is sufficient in the full temperature and/or pressure range of operation of the sample module, even if the sample module expands more than the sample chamber.

When the cover 342 is retracted (not shown), the hydraulic jack may be extended under pressurized hydraulic fluid (e.g., using a surface source) to fully compress the washer 852. An axial lock 1158 may then be inserted and the pressure in the hydraulic cylinder 1152 released. The length of the axial lock 1158 is preferably dimensioned so that the counteracting spring force of spring member is sufficient to operate in a variety of wellbore temperatures and pressures.

FIG. 6D depicts an alternate shock absorber 552*d* with an alternate jack 1051'. The shock absorber is the same as the shock absorber 552*c* of FIG. 6C, except that an alternate jack is used. In this configuration, the jack includes opposing lead screws 1060*a* and 1060*b*, rotational lock 1172 and a jackscrew 1062.

The jackscrew 1062 is engaged in opposing lead screws 1060*a* and 1060*b*. Opposing lead screws 1060*a* and 1060*b* are provided with threaded connections 1061*a* and 1061*b* for mating connection with threads on jackscrew 1062. When the cover 342 is open (not shown), the distance between opposing lead screws 1060*a* and 1060*b* may be increased under torque applied to a central, hexagonal link 1171 until a desirable compression of the washer (spring member) 852 is achieved. Then a rotation lock 1172 may be inserted around the central, hexagonal link 1171 to prevent further rotation.

Figure 7:
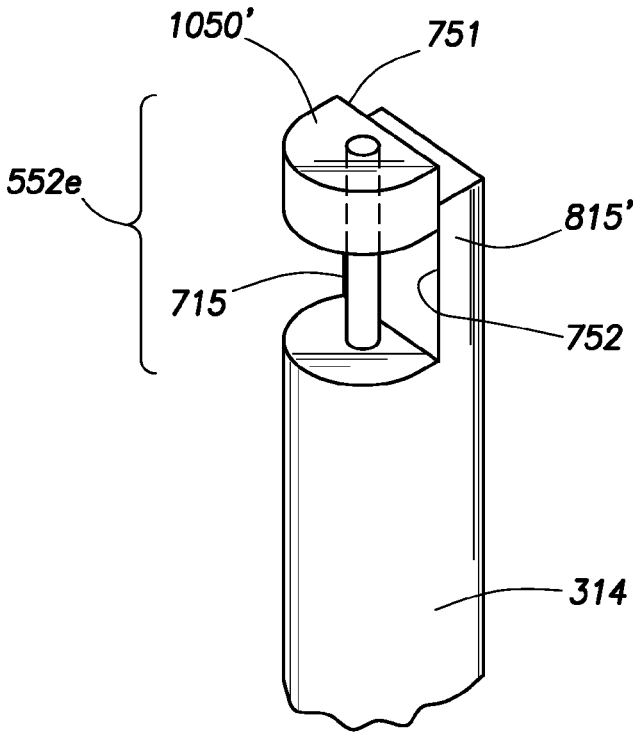
FIG. 7 is an isometric representation of an alternative shock absorber having a retainer usable with the sample module of FIG. 4A.

FIG. 7 illustrates an alternative retainer 552*e* usable as the shock absorber for a sample chamber, such as the one depicted in FIG. 4A. The retainer 552*e* includes an axial-loading spacer 1050' and a head component 715. Preferably, the axial load spacer has a flat sidewall 751 for engaging a complementing flat sidewall 752 of an end 815' of the sample chamber 314 and preventing relative rotation therebetween. The head component 715 is insertable into the axial loading spacer 1050' and the sample chamber to provide an operative connection therebetween. A spring member (not shown) may be provided about on a head component 815 of sample chamber 314 between the axial-loading spacer and the sample chamber.

Figure 8A:
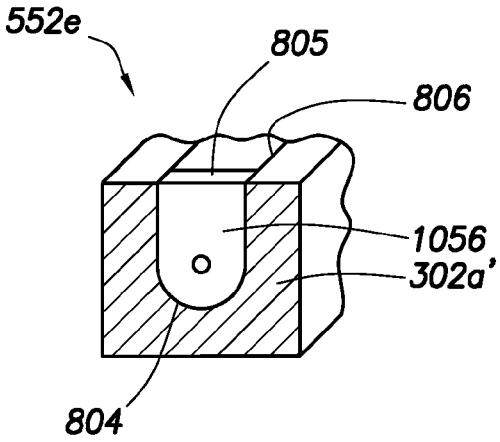
FIG. 8A is an alternate view of the shock absorber of FIG. 7 positioned in a drill collar.
Figure 8B:
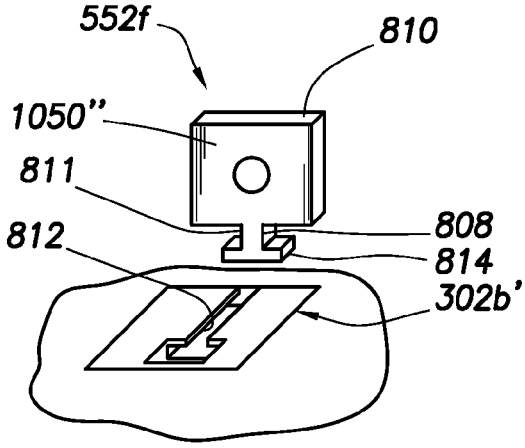
FIG. 8B is an exploded view of an alternate shock absorber and drill collar.
Figure 8C:
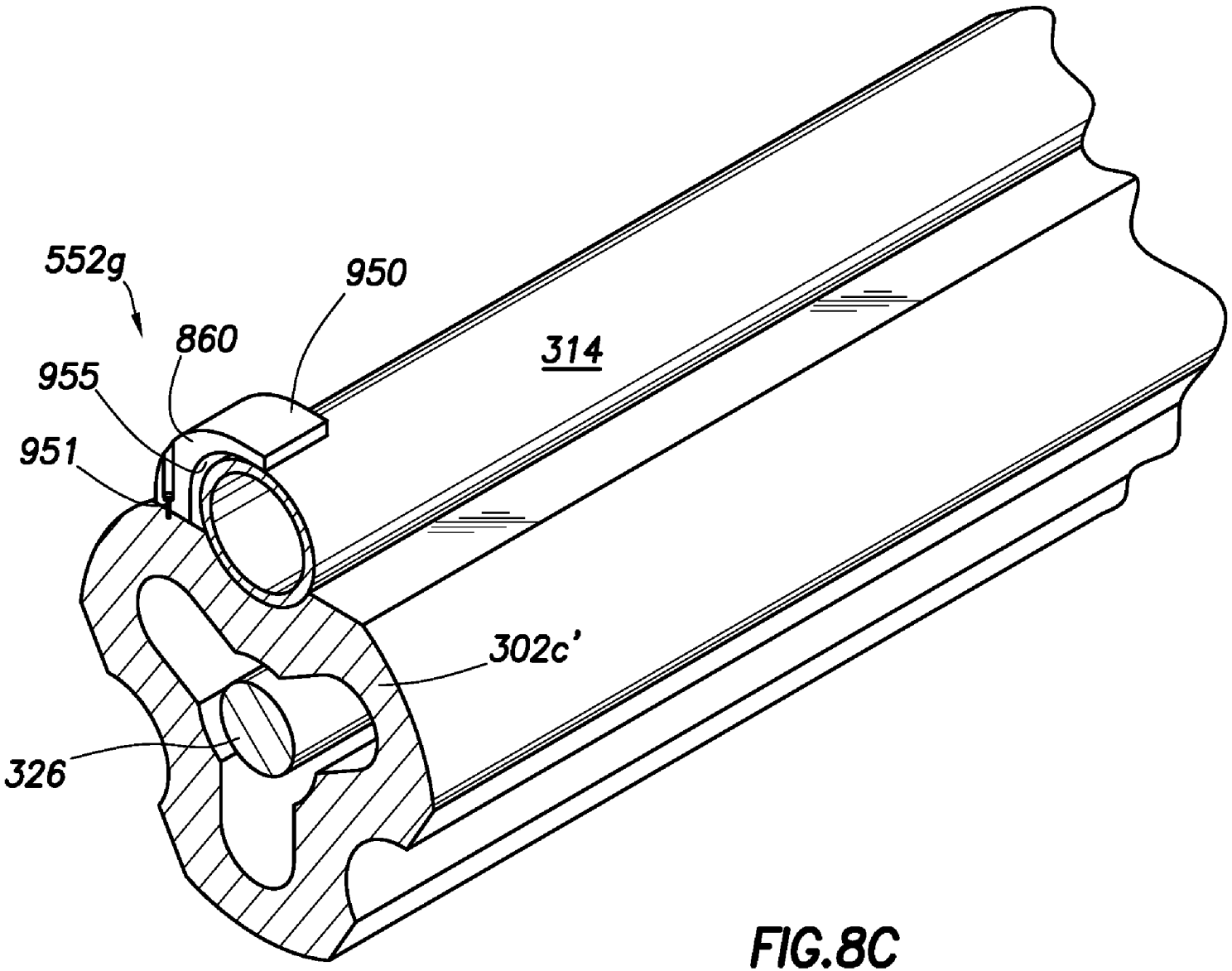
FIG. 8C is an isometric representation, partially in section, of an alternate shock absorber and drill collar.

FIGS. 8A-8C show alternative retainers usable with the sample chamber 314 of FIG. 7. FIG. 8A depicts the retainer 552*e* of FIG. 7 positioned in a drill collar 302*a*. FIG. 8B depicts an alternate retainer 552*f* having an axial-loading spacer 1050" having a key 808 insertable into a drill collar 302*b*'. FIG. 8C depicts an alternate retainer 552*g* having a radial retainer 860 operatively connected to a drill collar 302*c*'. The drill collars of these figures may be the same drill collar 302 as depicted in previous figures, except that they are adapted to receive the respective retainers. Preferably, these retainers and drill collars are adapted to prevent rotation and lateral movement therebetween, and provide torsional support.

As shown in FIG. 8A, the axial-loading spacer 1050' of retainer 552*e* has rounded and flat edge portions 804 and 805, respectively. Drill collar 302 has a rounded cavity 806 adapted to receive the axial loading spacer 1050'.

In FIG. 8B, the retainer 552*e* includes an axial-loading spacer 1050' having a rectangular periphery 810 and a key 808 extending therefrom. The key 808 is preferably configured such that it is removably insertable into a cavity 812 in drill collar 302*b*'. As shown, the key has an extension 811 with a tip 814 at an end thereof. The tip 814 is insertable into cavity 812, but resists removal therefrom. The dimension of cavity 812 is preferably smaller than the tip 814 and provides an inner surface (not shown) that grippingly engages the tip to resist removal. In some cases, it may be necessary to break the tip 814 to enable removal of the sample chamber when desired. Optionally, the tip may be fabricated such that a predetermined force is required to permit removal. In this manner, it is desirable to retain the sample chamber 314 in position in the drill collar during operation, but enable removal when desired.

FIG. 8C the alternative retainer 552*g* includes an arm 950 operatively connected to drill collar 302*c*'. The arm 950 is preferably connected to drill collar 302*c*' via one or more screws 951. Preferably, the arm 950 is radially movable in a hinge like fashion. The arm 950 has a concave inner surface 955 adapted to engage and retain sample chamber 314 in place in drill collar 302*c*'.

Preferably, the retainers provided herein permit selective removal of the sample chambers. One or more such retainers may be used to removably secure the sample chamber in the drill collar. Preferably, such retainers assist in securing the sample chamber in place and prevent shock, vibration or other damaging forces from affecting the sample chamber.

In operation, the sample module is threadedly connected to adjacent drill collars to form the BHA and drill string. Referring to FIG. 2A, the sample module may be pre-assembled by loading the sample chamber 314 into the aperture 303 of the drill collar 302. The interface 550 is created by positioning and end of the sample chamber 314 adjacent the flowline 311.

The interface 550 (also known as a pre-loading mechanism) may be adjusted at the surface such that a minimum acceptable axial or other desirable load is applied to achieve the required container isolation in the expected operating temperature range of the sample module 220, thereby compensating for greater thermal expansion.

Retainer 552 may also be operatively connected to an opposite end of the sample chamber to secure the sample chamber in place. The cover 342 may then be slidably positioned about the sample chamber to secure it in place.

The interface 550 at the (upper) end of the hydraulic connection may be laterally fixed, e.g., by conical engagement surfaces 315, 317 (see, e.g. FIG. 5A) as described above. The retainer 552 at the opposite (lower) end typically constrains axial movement of the sample chamber 314 (see, e.g., FIGS. 6A-8C). The two work together to hold the sample chamber within the drill collar 302. The cover 342 is then disposed about the sample chamber to seal the opening 305 of the sample chamber as shown, for example in FIG. 4A.

One or more covers, shock absorbers, retainers, sample chambers, drill collars, wet stabbers and other devices may be used alone and/or in combination to provide mechanisms to protect the sample chamber and its contents. Preferably redundant mechanisms are provided to achieve the desired configuration to protect the sample chamber. As shown in FIG. 4, the sample chamber may be inserted into the drill collar 302 and secured in place by interface 550, retainer 552 and cover 342. Various configurations of such components may be used to achieve the desired protection. Additionally, such a configuration may facilitate removal of the sample chamber from the drill collar.

Once the sample module is assembled, the downhole tool is deployed into the wellbore on a drillstring 12 (see FIG. 1). A sampling operation may then be performed by drawing fluid into the downhole tool via the probe module 210 (FIG. 1). Fluid passes from the probe module to the sample module via flowline 310 (FIG. 2A). Fluid may then be diverted to one or more sample chambers via flow diverter 332 (FIG. 3).

Valve 330*b* and/or 330*a* may remain open. In particular, valve 330*b* may remain open to expose the backside of the chamber piston 360 to wellbore fluid pressure. A typical sampling sequence would start with a formation fluid pressure measurement, followed by a pump-out operation combined with in situ fluid analysis (e.g., using an optical fluid analyzer). Once a certain amount of mud filtrate has been pumped out, genuine formation fluid may also be observed as it starts to be produced along with the filtrate. As soon as the ratio of formation fluid versus mud filtrate has reached an acceptable threshold, a decision to collect a sample can be made. Up to this point the liquid pumped from the formation is typically pumped through the probe tool 210 into the wellbore via dump flowline 260. Typically, valves 328 and 330 are closed and valve 334 is open to direct fluid flow out dump flowline 260 and to the wellbore.

After this flushing is achieved, the electrical valves 328*a* may selectively be opened so as to direct fluid samples into the respective sample cavities 307 of sample chambers 314. Typically, valves 334 and 330*b* are closed and valves 328*a*, 328*b* are opened to direct fluid flow into the sample chamber.

Once a sample chamber 314 is filled as desired the electrical valves 328*b* may be moved to the closed position to fluidly isolate the sample chambers 314 and capture the sample for retrieval to surface. The electrical valves 328*a*, 328*b* may be remotely controlled manually or automatically. The valves may be actuated from the surface using standard mud-pulse telemetry, or other suitable telemetry means (e.g., wired drill pipe), or may be controlled by a processor (not shown) in the BHA 100.

The downhole tool may then be retrieved from the wellbore 11. Upon retrieval of the sample module 220, the manually-operable valves 330*a, b* of sample chamber 314 may be closed by opening the cover 342 to (redundantly) isolate the fluid samples therein for safeguarded transport and storage. The closed sample cavities 312 are then opened, and the sample chambers 314 may be removed therefrom for transporting the chambers to a suitable lab so that testing and evaluation of the samples may be conducted. Upon retrieval, the sample chambers and/or module may be replaced with one or more sample modules and/or chambers and deployed into the wellbore to obtain more samples.

Figure 9:
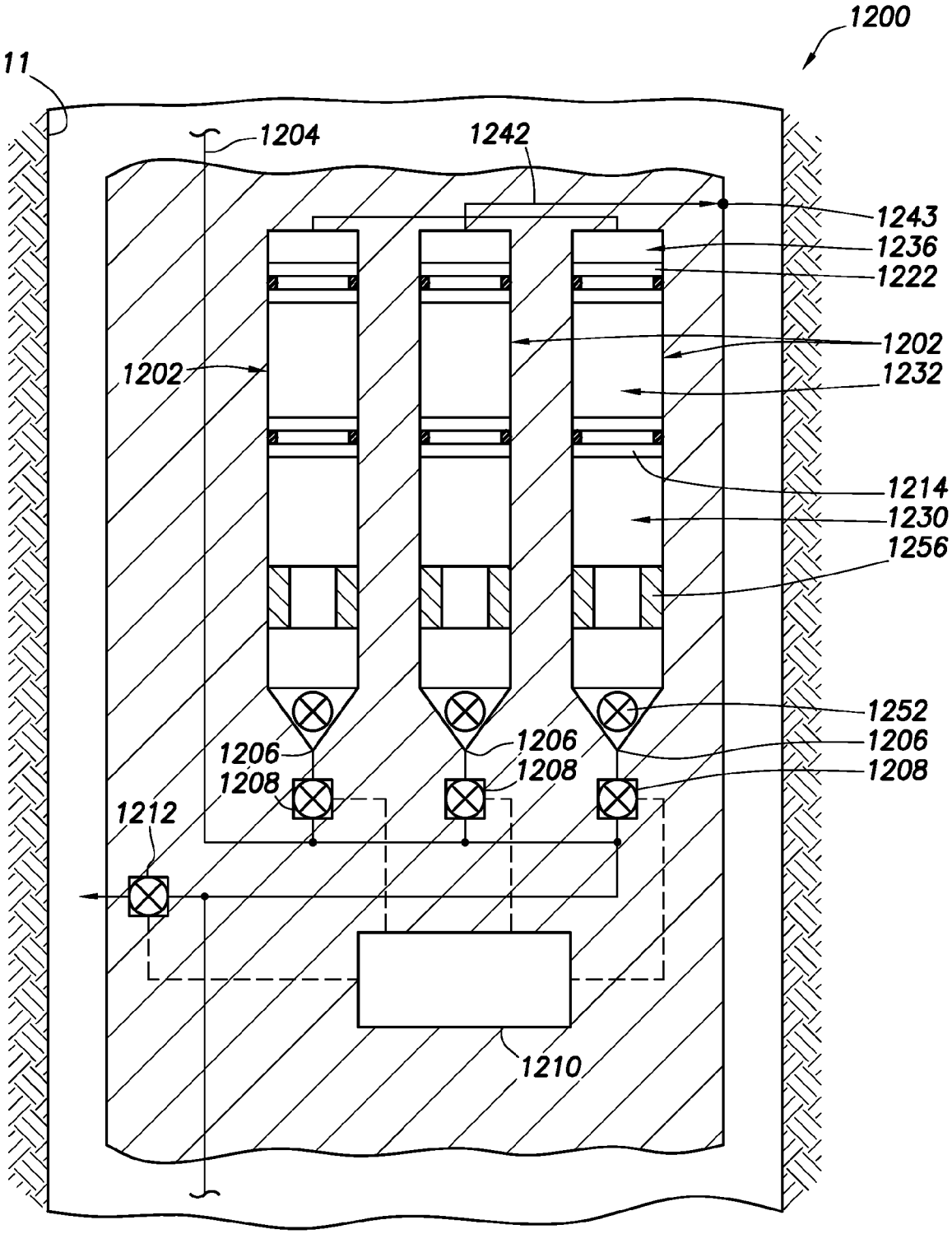
FIG. 9 is a schematic representation of an alternative fluid sampling system including a buffer volume disposed in each sample chamber.
Figure 10:
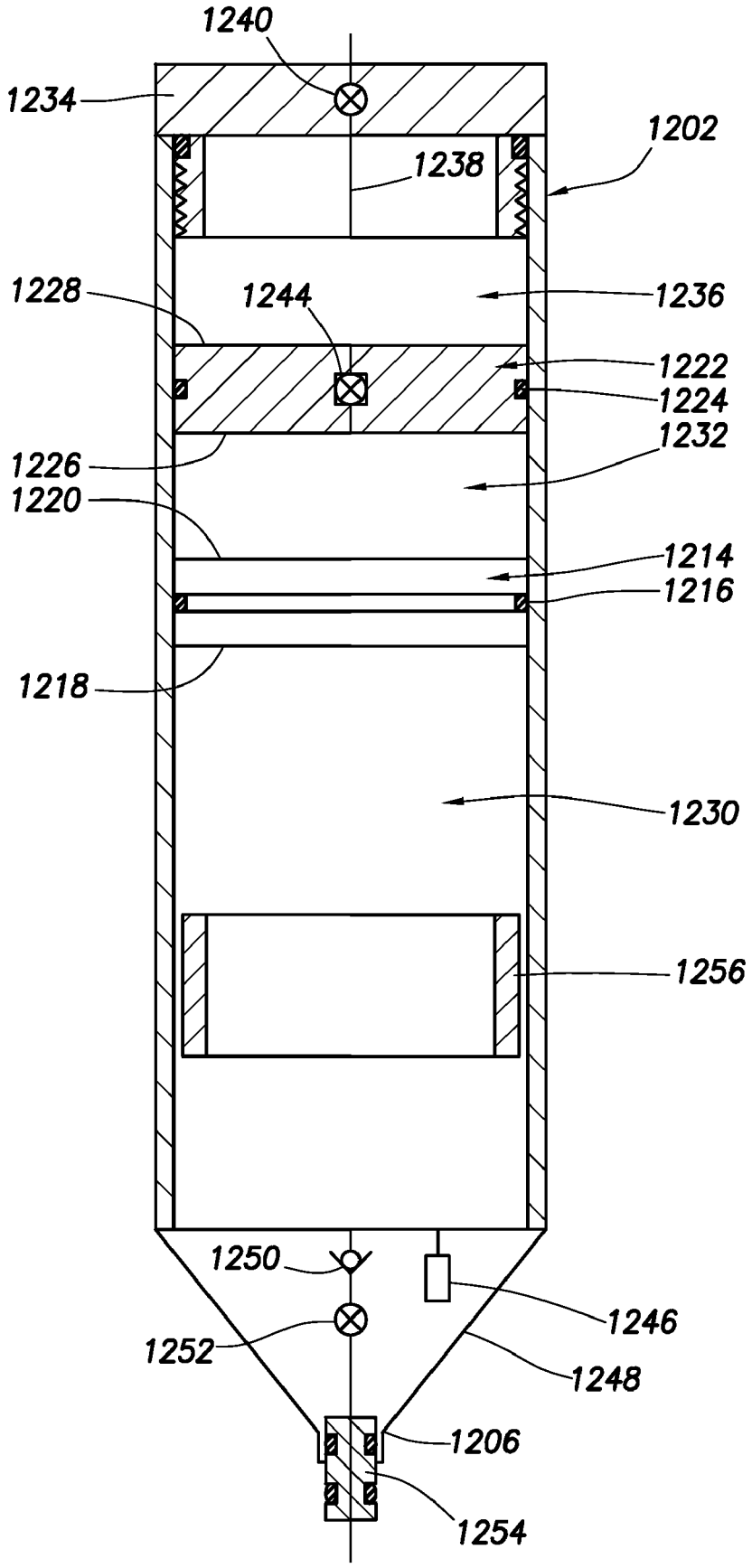
FIG. 10 is an enlarged schematic representation of a sample chamber used in the fluid sampling system of FIG. 9.

Referring to FIG. 9, an alternative fluid sampling system embodiment is illustrated having a buffer volume for minimizing the effects of shocks during drilling, amongst other advantages. The exemplary sample module 1200 includes three sample chambers 1202 fluidly coupled to a primary flowline 1204, which also fluidly communicates with a probe (not shown) adapted to receive formation fluid. The flowline 1204 branches out to fluidly communicate with each sample chamber 1202, thereby to form a network. While the illustrated embodiment shows three sample chambers 1202, it will be appreciated that more or less than three chambers may be provided without departing from the scope of this disclosure. The sample chambers 1202 are also illustrated as being inverted, so that a chamber inlet 1206 is at the bottom. When doing so, moving parts in the sample chambers 1202 will abut a bottle nose 1248, as best illustrated in FIG. 10, when the chamber is empty. This configuration may be advantageous when samples are taken when the drilling tool is pulled out of hole or late during the drilling program. Indeed, the moving parts in the chamber have a reduced movement during drilling, thereby reducing the odds of premature wear. Inverting the chambers 1202, however, is optional. For example, the chambers 1202 may not be inverted when samples are to be taken when the tool is tripping in the hole, or early in the drilling program.

Each sample chamber 1202 is selectively isolated from the primary flowline 1204 by an inlet valve 1208. The inlet valves 1208 may be provided as controllable valves, for example, seal valves, solenoid valves, or networks of single-shot valves. When the valves 1208 are open, the sample chambers 1202 are hydraulically coupled to the primary flowline 1204 via the network branches. A controller 1210 may be provided to operate the inlet valves 1208 based on commands issued from the surface or from other components within the BHA.

A bypass valve 1212 also fluidly communicates between the primary flowline 1204 and the wellbore 11. The bypass valve 1212 may be of the same construction as the inlet valves 1208 and may also be operatively coupled to the controller 1210. When the bypass valve 1212 is open, fluid from the flowline may flow directly into the wellbore 11. Such operation is useful during the initial phases of sampling, where mud filtrate that has invaded the formation is being extracted by the probe. Contaminated fluid may be directed to the wellbore 11 until clean formation fluid is obtained. The bypass valve 1212 may also be used to equalize pressure in the primary flowline 1204 during drilling.

A more detailed view of a sample chamber 1202 is provided in FIG. 10. A primary piston 1214 is slidably disposed in the chamber 1202 and includes a gasket 1216 that sealingly engages an interior wall of the chamber 1202. The primary piston 1214 defines a first or sample face 1218 and a second or buffer face 1220. A secondary piston 1222 is also slidably disposed in the chamber 1202 and includes a gasket 1224 that sealingly engages an interior wall of the chamber 1202. The secondary piston 1222 defines a first or buffer face 1226 and a second or mud face 1228. The primary piston 1214 divides the sample chamber 1202 into a sample volume 1230 and a buffer volume 1232. The sample volume 1230 communicates with the inlet 1206 to receive the formation fluid sample. A buffer fluid is disposed in the buffer volume 1232. The secondary piston 1222 maintains the desired volume and pressure of the buffer fluid in the buffer volume 1232. The buffer fluid has a known volume, initial pressure, and composition (that is preferably immiscible with the formation fluid). The buffer fluid may be a liquid (such as water or oil) or a gas (such as air or an inert gas). An outlet end of the chamber 1202 is sealed by a plug 1234 to define a back end volume 1236 between the plug 1234 and secondary piston second face 1228. The plug 1234 includes a passage 1238 and a manual valve 1240 for selectively establishing fluid communication between the back end volume 1236 and a mud flowline 1242 (FIG. 9) that communicates to the wellbore 11 via a mud orifice 1243 (FIG. 9). A port valve 1244 is provided for filling and draining the buffer fluid at surface.

The buffer volume 1232 of the exemplary sample chamber 1202 protects the captured formation fluid sample from contamination during drilling. The buffer fluid, which is of a known composition and may be free of abrasive solids, extends the life of the gasket 1216 and minimizes cross contamination between the sample fluid and mud. Should the buffer fluid leak into the formation sample, it may be easily isolated and separated due to its known composition. Additionally, the buffer fluid may be used to maintain the sample fluid in a single phase. For example, the buffer volume 1232 may be filled with nitrogen at the surface to an elevated pressure that may be selected based on the job profile and expected wellbore conditions. The nitrogen buffer will therefore act as a passive pressure compensation mechanism to keep the sample at an elevated pressure as it returns to the surface.

The sample chamber 1202 may further include one or more sensors 1246 for measuring one or more physical properties of the captured sample fluid. The sensor 1246 may be embedded in a nose 1248 of the chamber 1202, and may be in pressure and/or hydraulic communication with the sample volume 1230. The sensor 1246 may be communicatively coupled to a memory (not shown) to log data over time to monitor fluid integrity during all phases of the operation (including lab analysis). The sensor 1246 may measure physical properties of the fluid being extracted from the formation, which include (but are not limited to) optical spectrometer, density, viscosity, pressure, fluorescence, gamma ray, x-ray, magnetic-resonance, pressure, and temperature.

The sample chamber 1202 may also include a check valve 1250 near the inlet 1206. This is particularly useful when a condensate gas is sampled and the chamber 1202 is inverted as shown to prevent any fluid in the liquid phase from being lost into the flowline network. A manual transfer valve 1252 may also be provided in the sample chamber 1202. The transfer valve 1252 may normally be in an open position as the tool is lowered and during sampling. Subsequently, it may be manually closed when the tool is returned to the surface with a formation fluid trapped in the chamber 1202. With the transfer valve 1252 closed, the chamber 1202 may be safely removed from the tool. A stabber 1254 may be provided at the inlet 1206 to facilitate insertion and removal of the chamber 1202 into and out of the tool.

Figure 11:
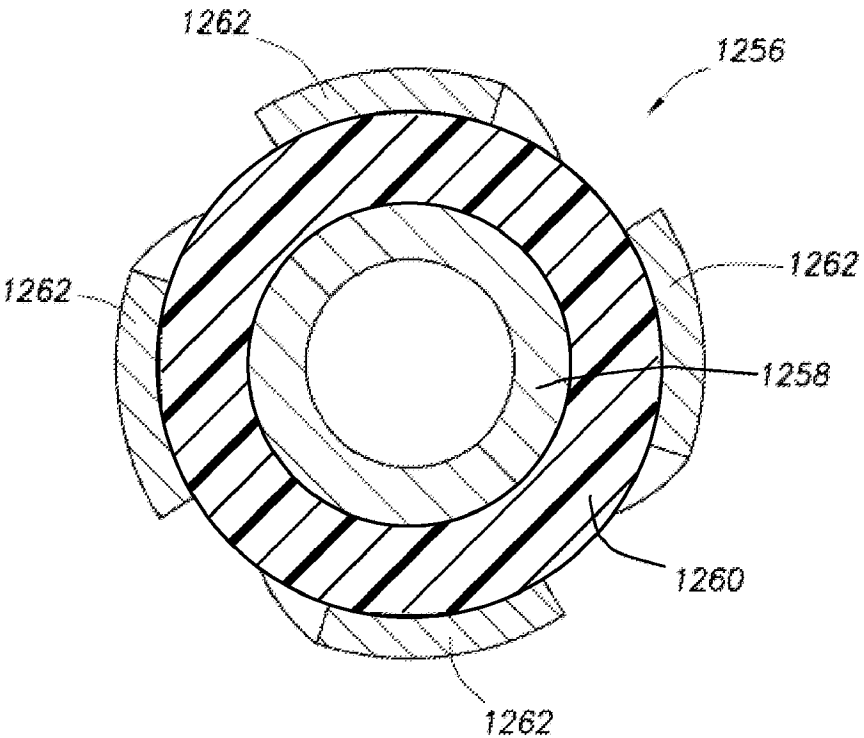
FIG. 11 is an enlarged cross-sectional view of an agitator disposed in the sample chamber of FIG. 10.

A mixing ring or agitator 1256 may be disposed in the sample chamber 1202 to recondition the sample fluid for lab testing. The exemplary agitator 1256 illustrated in FIG. 11 includes an inner core 1258 and an outer body 1260. The inner core 1258 may be metallic and provides structural integrity and sufficient weight to move the agitator 1256 through viscous fluids, such as heavy oil samples. Due to the high shock nature of the while drilling environment, the outer body 1260 is designed to protect the interior wall of the sample chamber 1202 from damage. Accordingly, the outer body 1260 may be made of a material having a lower hardness than the chamber interior wall, such as aluminum bronze, copper, or PEEK. The outer body 1260 may further have castellations 1262 that allow particles in the sample fluid to move freely. The castellations may have a straight, spiral (as shown), or other arrangement along an exterior surface of the outer body 1260. To recondition a sample fluid for lab testing, the sample may be heated and the chamber 1202 rocked back and forth so that gravity moves the agitator 1256 back and forth within the sample volume 1230. Alternatively, the inner core 1258 may be magnetic and an exterior magnet may be used to slide the agitator 1256 within the sample chamber 1202.

Figure 12:
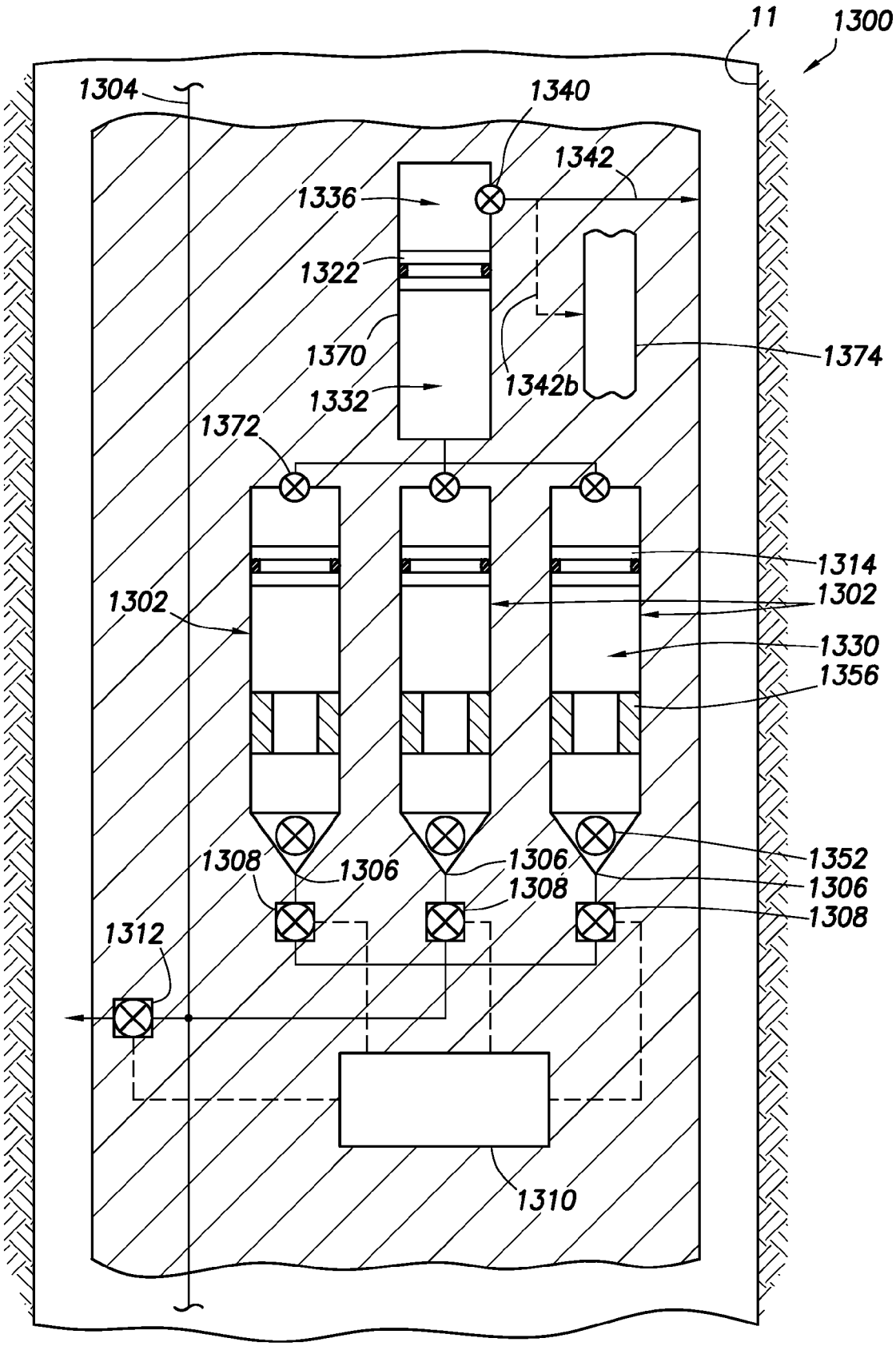
FIG. 12 is a schematic representation of a further alternative fluid sampling system including a buffer chamber with a buffer volume.

An alternative fluid sample module 1300 having a buffer fluid is illustrated in FIG. 12. The fluid sample module 1300 includes similar components to the module 1200, and therefore like reference numerals are used to identify like components. The primary difference in the module 1300 is that a separate buffer chamber 1370 is provided in fluid communication with the sample chambers 1302. The secondary piston 1322 is disposed in the buffer chamber 1370 to define the buffer volume 1332 and the back end volume 1336. The primary and secondary pistons 1314, 1322 may have different cross-sectional areas; however the buffer chamber 1370 should have a volume sufficient to hold the volume of buffer fluid that is initially provided in the sample chambers 1302. Additional transfer valves 1372 are provided at outlets of the sample chambers 1302 to facilitate removal of the chambers at the surface. Also illustrated in FIG. 12 is an alternative mud flowline 1342*b* that fluidly communicates with a mud flowline 1374 extending through the drill string. By separating the sample and buffer volumes 1330, 1332, the fluid sample module 1300 prevents mud from entering the sample chambers 1302, thereby to provide a cleaner environment for the collected samples.

Figure 13:
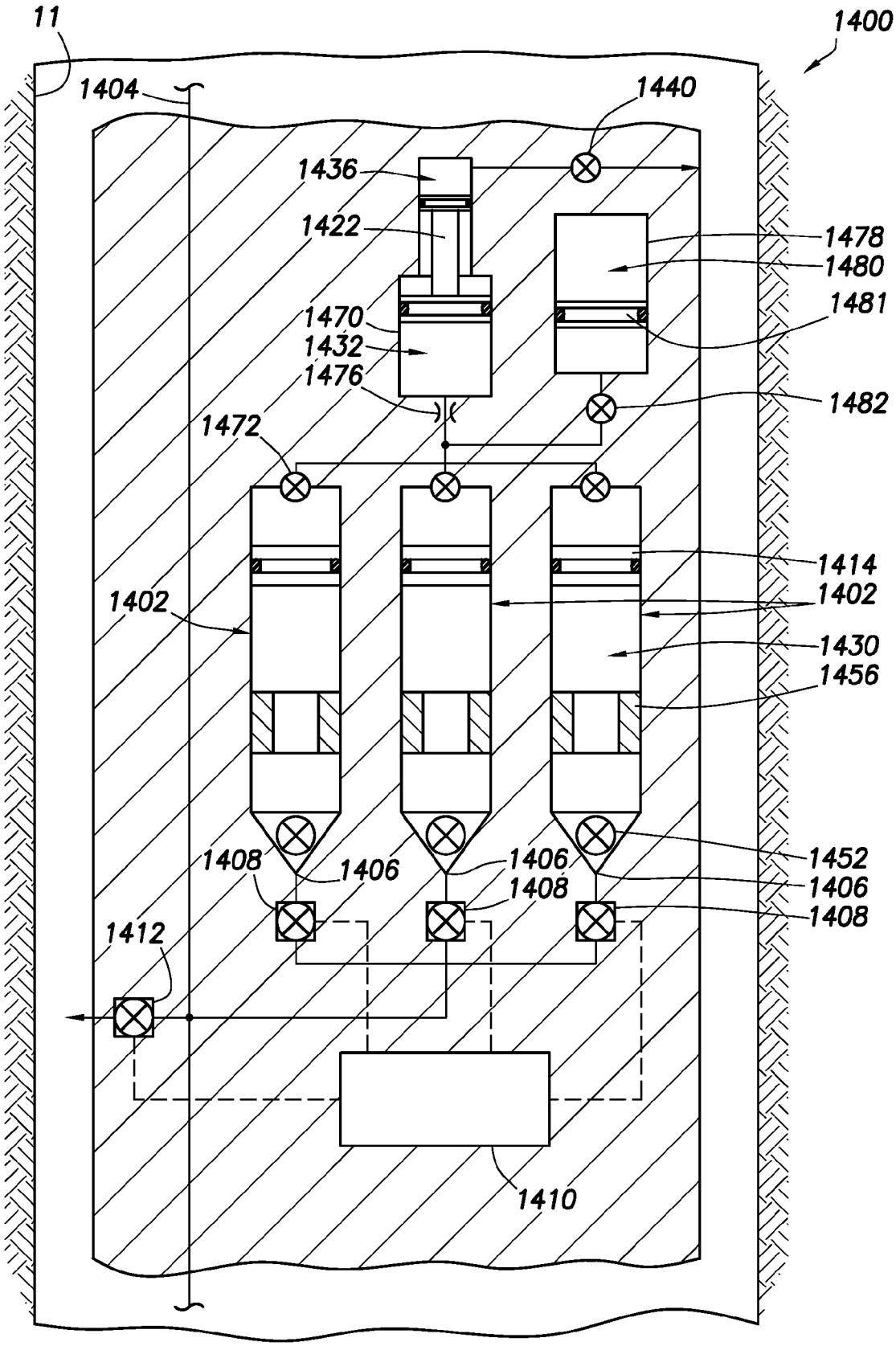
FIG. 13 is a schematic representation of yet another alternative fluid sampling system similar to the system of FIG. 12 but with a stepped piston in the buffer chamber.

A further embodiment illustrated in FIG. 13 shows a fluid sample module 1400 almost identical to the sample module 1300 of FIG. 12, except the secondary piston 1422 is stepped. As shown, the secondary piston 1422 is slidably disposed in the buffer chamber 1470, which is also stepped. A throttle valve 1476, which may be operated by the controller 1410, is provided between the buffer chamber 1470 and the sample chambers 1402. The module 1400 may further include a dump chamber 1478 including a dump chamber volume 1480 holding a gas at substantially atmospheric pressure. The dump chamber also includes an optional dump piston 1481. The dump chamber 1478 may be used to reset the secondary piston 1422 after a fluid sample is drawn into a sample chamber 1402. In operation, the bypass valve 1412 is closed and one of the inlet valves 1408 is opened to establish fluid communication between the primary flowline 1404 and a sample volume 1430. The rate of flow into the sample volume 1430 may be controlled by the throttle valve 1476. Preferably, valve 1476 is under the action of a controller which is not shown in the figure. Once a sample is captured, the controllable transfer valve 1472 is closed (under the control of the controller 1210) and a seal valve 1482 is opened to communicate the atmospheric pressure to the buffer chamber 1470, thereby driving the secondary piston 1422 to the initial position to repeat sample capture with a different sample chamber 1402.

Figure 14:
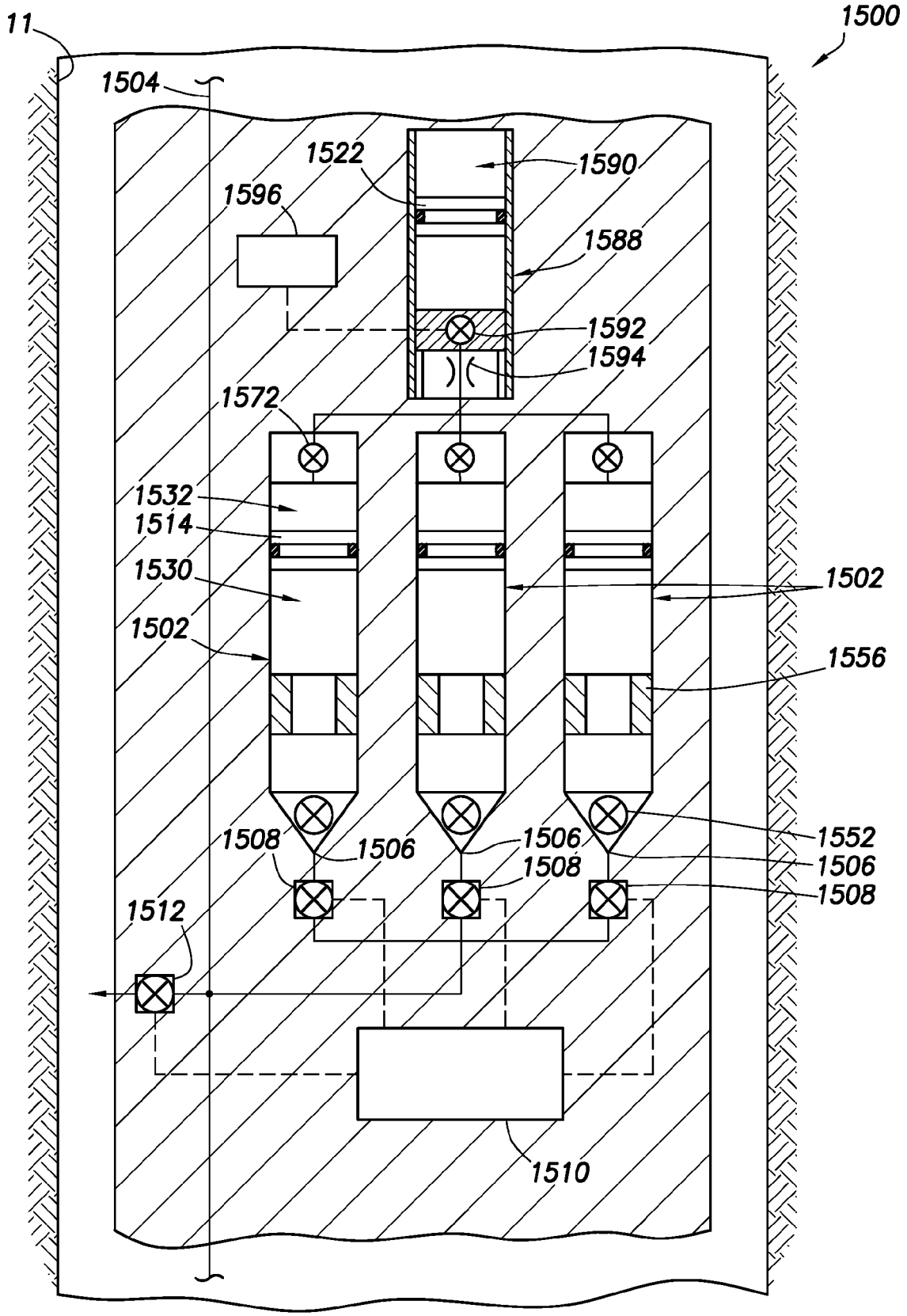
FIG. 14 is a schematic representation of a further alternative fluid sampling system with a buffer chamber that includes a dump chamber.

Yet another fluid sample module 1500 is illustrated in FIG. 14. The module 1500 includes sample chambers 1502 in fluid communication with a water-cushion dump chamber tank 1588. Only the primary pistons 1514 are disposed in the sample chambers 1502. The sample chambers 1502 further include outlet valves 1572. The dump chamber tank 1588 includes a low-pressure chamber 1590 that is filled with a gas substantially at atmospheric pressure, or at a pressure approximately 100 to 200 psi in order to maintain the parts of the apparatus in place while drilling. An optional secondary piston 1522 is disposed in the tank 1588. An inlet of the chamber 1590 includes a seal valve 1592 for communicating atmospheric chamber volume 1590 to the buffer volume 1532 and a choke 1594 to meter buffer fluid flow, thereby controlling sampling production rate. The seal valve 1592 may be operatively coupled to a controller 1596. The buffer fluid may be a liquid, such as water, to provide a cushion to the shocks experienced during drilling.

Figure 15:
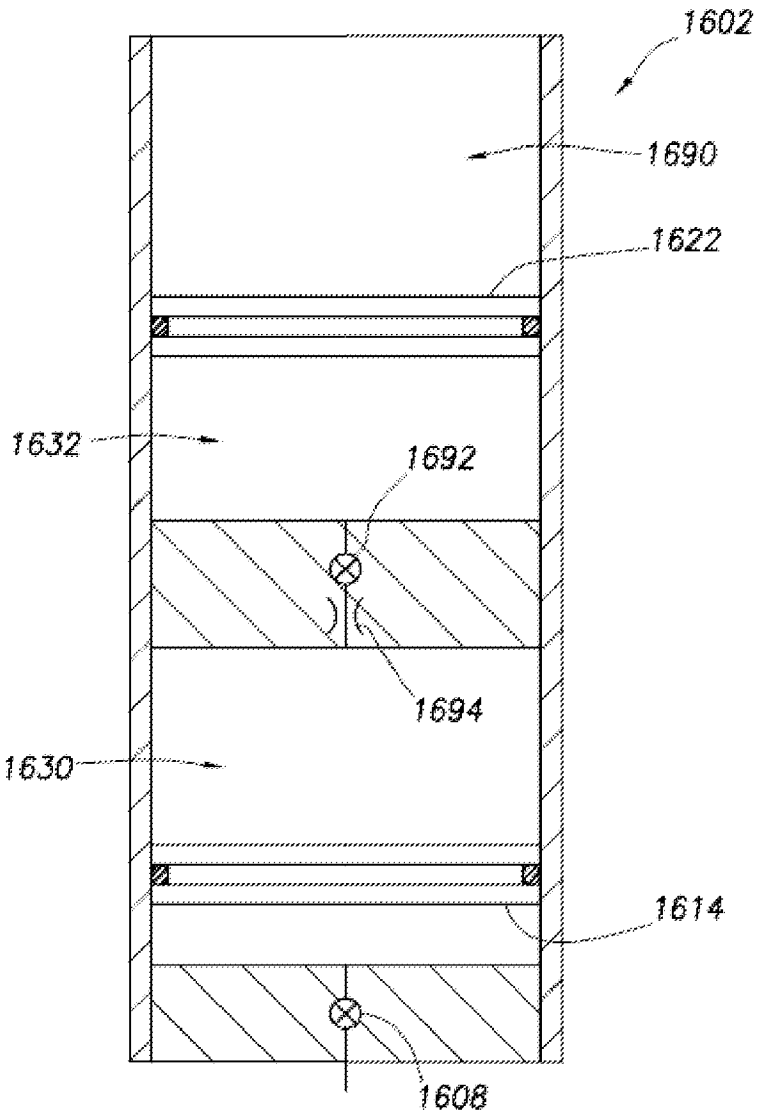
FIG. 15 is an enlarged schematic representation of an alternative buffer chamber for use in the system of FIG. 14.

A variation of the water-cushion dump chamber is illustrated in FIG. 15. In this example, the sample chamber 1602 includes both the primary piston 1614 and the secondary piston 1622. The sample chamber also incorporates the low-pressure chamber 1690, seal valve 1692, and choke 1694.

Figure 16:
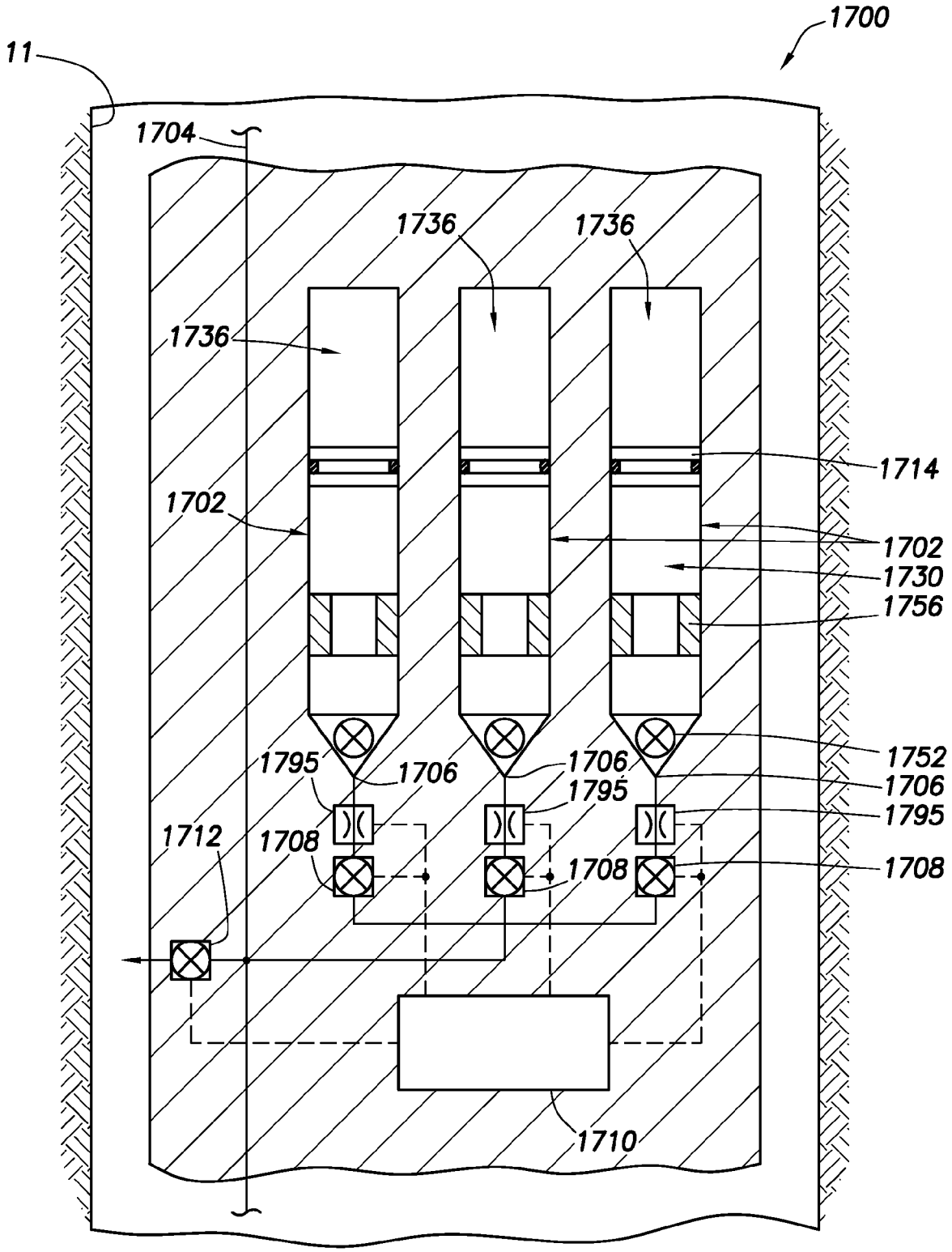
FIG. 16 is a schematic representation of a further alternative fluid sampling system which includes an isolated dump chamber.

An alternative embodiment of a fluid sample module 1700 is illustrated in FIG. 16. The module 1700 includes three sample chambers 1702 having back ends that are isolated from the remainder of the tool. A back end volume 1736 of each chamber 1702 is filled with a gas at substantially atmospheric pressure to create an atmospheric dump chamber. An optional choke 1795 may be provided in each branch flowline to meter fluid flowing into the sample chambers 1702. As shown in FIG. 16 the throttling has been disposed close to the bottle opening to alleviate the problem of losing the light ends of the sampled hydrocarbon; better still would be to put the chokes in the bottle themselves. In operation, when the inlet valve 1708 of a selected sample chamber 1702 is opened, fluid will flow into the sample chamber 1730 from the primary flowline 1704 due to exposure to a low pressure sink in the back end volume 1736. Fluid flow into the sample volume 1730 will continue until the pressure in sample volume 1730 and back end volume 1736 are equalized. The choke 1795 may be operated to control the rate of flow into the sample chamber 1730.

Figure 17:
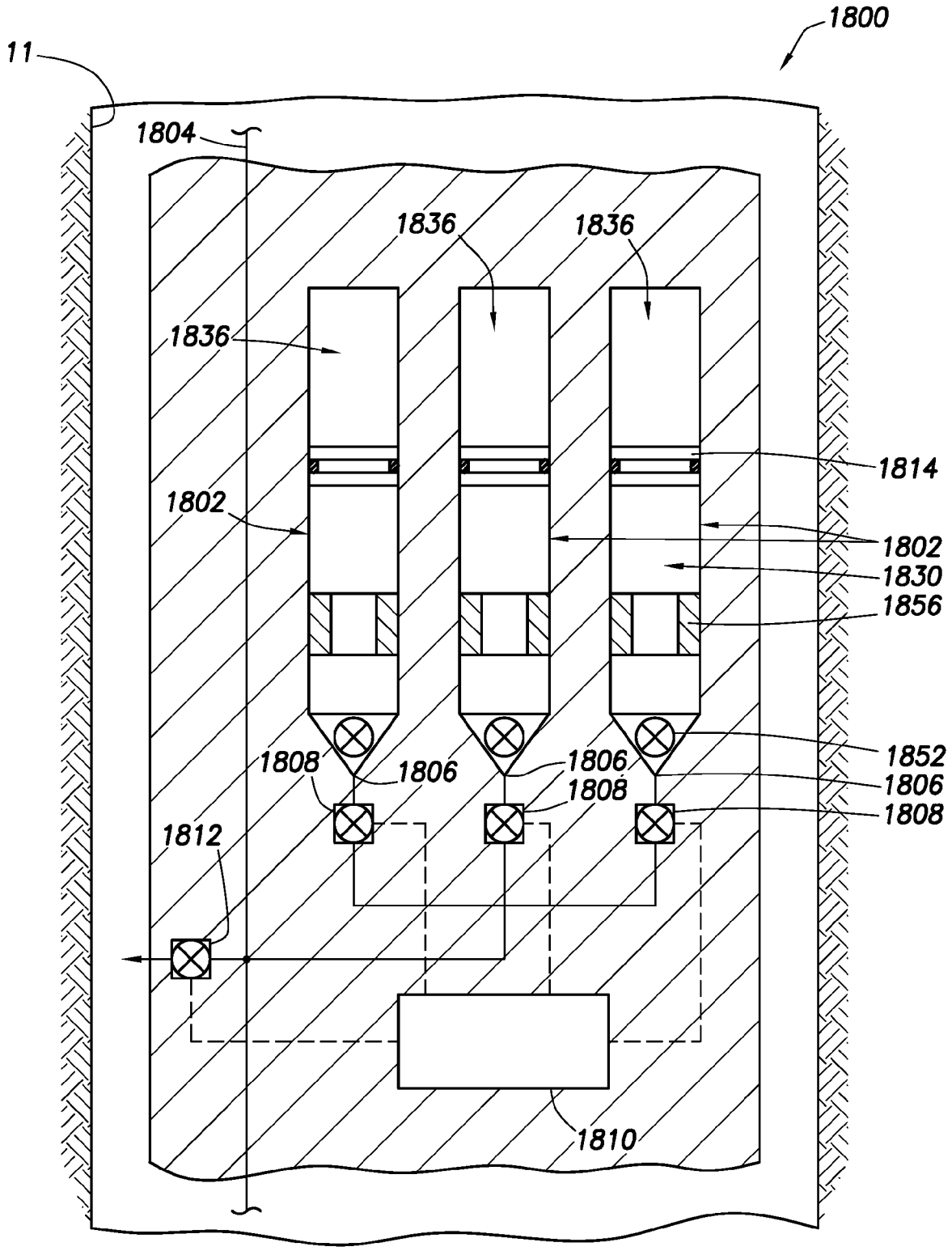
FIG. 17 is a schematic representation of a still further alternative fluid sampling system which includes a pressurized chamber.

Yet another embodiment of a fluid sample module 1800 is shown in FIG. 17. The module 1800 includes three sample chambers 1802 having back ends that are isolated from the remainder of the tool. In this embodiment, the back end volume may be pressurized at a pressure lower than the expected formation pressure, e.g. 5 kpsi, providing thereby a lower pressure differential as the sample chamber is opened.

More specifically, a back end volume 1836 of each chamber 1802 is filled with a gas at a pressure substantially above atmospheric pressure: preferably, a pressure slightly above the wellbore pressure if the formation to be sampled is normally pressured. The value of the back end pressure at surface may be adjusted by well known methods to allow for the temperature difference between surface and sampling depth. The pressure of the back end volume 1836 may vary from sample chamber to sample chamber depending on the anticipated formation pressures of the formations to be sampled. Whether the formation is normally pressured or substantially depleted is known directly from information provided by the sampling while drilling tool prior to the initiation of sampling.

In operation, during removal of the mud filtrate of a normally pressured formation, bypass valve 1812 is open and fluid from the primary flowline 1804 is discharged into the wellbore 11. When inlet valve 1808 is opened no fluid passes into the sample chamber 1802 since the pressure in the back end volume 1836 is at or slightly higher than the well pressure. Closing the bypass valve 1812 diverts sampled fluid into the sample chamber 1802 through the inlet valve 1808 forcing the sample chamber piston 1814 into the back end volume 1836 and compressing the gas therein. Sampled fluid continues to fill the sample chamber 1802 until the sampling pump output pressure can no longer overcome the pressure in the back end volume 1836. Inlet valve 1808 is then closed trapping the formation fluid sample in the sample chamber 1802. The pressure in the back end volume 1836 acting on the formation fluid captured in the sample chamber 1802 serves to keep the sample in a single phase state even when the sample is transported to surface.

It will be understood from the foregoing description that various modifications and changes may be made in the preferred and alternative embodiments of the present disclosure without departing from its true spirit.

This description is intended for purposes of illustration only and should not be construed in a limiting sense. The scope of this disclosure should be determined only by the language of the claims that follow. The term "comprising" within the claims is intended to mean "including at least" such that the recited listing of elements in a claim are an open set or group. Similarly, the terms "containing," having," and "including" are all intended to mean an open set or group of elements. "A," "an" and other singular terms are intended to include the plural forms thereof unless specifically excluded. It is the express intention of the applicant not to invoke 35 U.S.C. Section 112, paragraph 6 for any limitations of any of the claims herein, except for those in which the claim expressly uses the words "means for" together with an associated function.

What is claimed:

1. A sample module for a sampling while drilling tool positionable in a wellbore penetrating a subterranean formation, comprising:

a sample chamber having an inlet configured to receive a downhole fluid from a sample fluid flowline;

a primary piston slidably disposed within the sample chamber and dividing the sample chamber into a sample volume and a buffer volume; and an agitator disposed in the sample volume and comprising an inner core and an outer body, wherein the outer body comprises a material having a lower hardness than an interior wall of the sample chamber.

2. The sample module of claim 1 wherein the inner core comprises a material having a greater hardness than the material of the outer body.

3. The sample module of claim 1 wherein the outer body substantially comprises PEEK (polyetheretherketone) and the inner core substantially comprises metal.

* * * * *